US012239893B2

(12) United States Patent
Krause et al.

(10) Patent No.: US 12,239,893 B2
(45) Date of Patent: Mar. 4, 2025

(54) SPEED-PONG GAME

(71) Applicants: Gary R. Krause, Livonia, MI (US); Kevin C. Morse, Flint, MI (US)

(72) Inventors: Gary R. Krause, Livonia, MI (US); Kevin C. Morse, Flint, MI (US)

( * ) Notice: Subject to any disclaimer, the term of this patent is extended or adjusted under 35 U.S.C. 154(b) by 979 days.

(21) Appl. No.: 17/244,937

(22) Filed: Apr. 29, 2021

(65) Prior Publication Data

US 2021/0291027 A1 Sep. 23, 2021

Related U.S. Application Data

(63) Continuation-in-part of application No. 15/884,586, filed on Jan. 31, 2018, now Pat. No. 11,027,179.

(51) Int. Cl.

| | |
|---|---|
| ***A63B 67/06*** | (2006.01) |
| ***A63B 63/08*** | (2006.01) |
| ***A63B 67/04*** | (2006.01) |
| ***A63B 71/06*** | (2006.01) |

(52) U.S. Cl.

CPC ..... *A63B 67/06* (2013.01); *A63B 63/08* (2013.01); *A63B 67/04* (2013.01); *A63B 71/06* (2013.01); *A63B 2071/0694* (2013.01); *A63B 2225/093* (2013.01)

(58) Field of Classification Search

CPC ..... A63B 67/06; A63B 63/08; A63B 67/04; A63B 71/06; A63B 2071/0694; A63B 2225/093; A63B 71/023; A63B 2209/00; A63B 2225/10; A63B 71/022

See application file for complete search history.

(56) References Cited

U.S. PATENT DOCUMENTS

| | | | | |
|---|---|---|---|---|
| 3,372,934 A * | 3/1968 | Heil | A63F 9/0204 | 273/342 |
| 4,177,737 A * | 12/1979 | Brickman | A47B 3/10 | 108/118 |
| 5,007,650 A * | 4/1991 | Reed | A63F 3/00006 | 273/249 |
| 6,276,686 B1 * | 8/2001 | Chille | A63F 3/00088 | 273/248 |
| 7,325,807 B1 * | 2/2008 | Eason | A63B 67/002 | 273/342 |

(Continued)

*Primary Examiner* — Jeffrey S Vanderveen

(74) *Attorney, Agent, or Firm* — J. Gordon Lewis

(57) ABSTRACT

A portable game includes a lower table forming a circular playing surface and an edge having a diameter D1, an upper table forming a circular playing surface and an edge having a diameter D2, wherein D1>D2. A vertical support member interconnects the lower and upper tables. Cup positioning markers are formed on said first and second table playing surfaces for locating said beverage cups thereon. An elongated barrier assembly extends vertically above said playing surface and horizontally bisects the upwardly firing playing surface. The vertical barrier is operative to define discrete opposed team play areas enabling a plurality of teams to play simultaneously on opposed sides of said barrier and to prevent horizontal travel of ping pong balls between opposing team play areas. The barrier is supported by at least one vertically elongated support stanchion slip-fit within the playing surfaces to enable selective removal and insertion thereof.

20 Claims, 19 Drawing Sheets

(56) References Cited

U.S. PATENT DOCUMENTS

| | | | | |
|---|---|---|---|---|
| 7,516,960 | B1 * | 4/2009 | Battiste | A47B 25/00 273/342 |
| 7,805,959 | B2 * | 10/2010 | Webb | A63B 67/002 62/530 |
| 7,806,959 | B2 | 10/2010 | Webb et al. | |
| 8,905,406 | B2 * | 12/2014 | Brown | A63B 67/066 273/342 |
| 8,906,406 | B2 | 12/2014 | Brown | |
| D755,898 | S * | 5/2016 | Blanchard | D21/302 |
| 2004/0188942 | A1 * | 9/2004 | Trokan | A63F 7/0017 273/342 |
| 2005/0029747 | A1 * | 2/2005 | Grayson | A63B 63/08 273/342 |
| 2005/0116413 | A1 * | 6/2005 | Wagner | A63F 9/001 273/242 |
| 2006/0226606 | A1 * | 10/2006 | Finley | A63B 67/002 273/342 |
| 2007/0200293 | A1 * | 8/2007 | Gomez | A63F 3/00006 273/242 |
| 2011/0096263 | A1 | 4/2011 | Medendorp, Jr. et al. | |
| 2012/0169012 | A1 * | 7/2012 | Parker | A63B 67/002 273/400 |
| 2014/0015197 | A1 * | 1/2014 | Maffei | A63F 7/0017 273/348 |

* cited by examiner

SPEED-PONG GAME

RELATED PATENT APPLICATIONS

This application is a continuation-in-part and claims priority to U.S. patent application Ser. No. 15/884,586 filed 31 Jan. 2018, entitled "PORTABLE TAILSPORTS GAME".

TECHNICAL FIELD

The present invention is generally related to popular drinking games played on a table surface or mounted target by two or more players. More particularly, the present invention relates to a table top assembly for playing ball games commonly known as Beer Pong, Flip Cup, Canoe, Batavia Downs, Survivor. Flip Cup, Taps, Flippy Cup, Tippy Cup and the like.

BACKGROUND OF THE INVENTION

There are many types of drinking games that require the use of a planar playing surface, especially a table. Among these are games commonly referred to as "Beer Pong" and "Flip Cup".

In "Beer Pong" and its variants, cups containing a beverage, typically an alcoholic beverage, are placed near opposing ends of the play surface, in a configuration determined by the rules of the particular game. The game is played by two sides or teams, each side consisting of one or more players, but usually with an equal number of players on each side. The sides stand at the respective ends of the playing surface, behind one set of the cups. In turn, a player from each side attempts to propel an object, usually a ball, and typically a ping-pong or table tennis ball, from the team's end of the playing surface into one of the cups at the opposite end of the playing surface, causing it to come to rest therein. In some variants of the game, the object is thrown; in other variants of the game, the side on the offence has the opportunity to take two successive attempts.

Depending upon the particular set of rules adopted, the defending side may defend its cups. In one variation, no defense is permitted, yet in other variants, the defending side may use hands, a paddle, or the like. If the ball comes to rest in a defending side's cup, the defending side must drink the contents thereof and the cup is removed from the playing field. When two balls are used and the offensive side is successful in landing both in the cups, the defensive side may be required to remove an additional cup from play and drink its contents. As cups are removed from play, some rule variations allow (or require) re-arrangement of the remaining cups. The side to remove all of the opponent's cups from the playing surface is the winner, and most rule variations require that the contents of any cups remaining on the winning side's end of the playing surface must be consumed by the losing side.

It is common to play the game of "Beer Pang" in a round-robin or elimination-type tournament, with many matches occurring in a venue on a number of playing surfaces. In such a format, the state of inebriation of members of each side may depend upon its success (or lack thereof) in prior matches.

The cups used in the game are usually of the disposable, plastic variety, typically with about a capacity of from about 10 to 16 liquid ounces. A typical material for such a cup is poly (ethylene terephthalate), sometimes referred to as PETE. An amount of a beverage (usually 3 to 6 ounces) is added to each cup at the start of a game. Based upon a 12 ounce container (can or bottle), about 2 to about 5 cans or bottles will be imbibed per team per game to achieve this. A ping pong ball, with a nominal diameter of about 4 cm. will be about ½ of the diameter of the open end of the cup, so it is reasonably sized for the game. Also, with its light weight and density, the ping pong ball keeps spillage and splashing down from that which would occur with a denser ball.

The preferred playing field of known games is from about six to eight feet long, with a width in the range of about two to three feet. The cups are typically arranged within 18 inches from an end of the playing field, but usually no closer than about 4 inches from an end. As such, the typical playing field is slightly shorter in length than a conventional table tennis table, and about ½ as wide. The typical playing field is similar in shape and size to that of the surface of a door. The playing field is usually placed on a flat horizontal position about 29 inches off of the floor, that is, at the approximate height of a conventional table.

Until now, Beer Pong players have had to play the game on a variety of makeshift playing fields, including kitchen tables, homemade platforms, and old doors, all of which prove to be inadequate. Since the size of the playing surface is not standardized and because it is not primarily intended for use in the game, the cups are not consistently thereon. This can unfairly affect the difficulty of the game. To promote fairness, it is important that the cups are placed in the same starting and regrouping positions on each end of the playing surface, and that this placement is consistent from game to game. It is therefore desirable for the game to be played on a surface that mandated the correct and consistent placement of cups.

A search of issued U.S. patents in the field of known drinking games and related apparatus reveals U.S. patents related generally to the field of the present invention but which do not anticipate nor disclose the device of the present invention. The discovered U.S. patents relating generally to the present invention are discussed herein below.

Published U.S. Patent Application No. 2005/0029747 A1 to Grayson entitled "Drinking Game Cup Holder" describes a drinking game cup holder that provides a plurality of cup-receiving openings. The holder places the cups within the holder in a correct relationship, but it does not provide a means for correctly positioning the cups at the opposite ends to each other. To this extent, the Grayson '747 published application exemplifies the fact that the game has been commonly played on a variety of make-shift playing fields.

Published U.S. Patent Application No. 2004/01889942 A1 to Trokan entitled "Non-Alcoholic Beer-Pong Game/System" describes a non alcoholic drinking game system, but the invention is concerned with the game rules and physical properties of the balls used in the game. While Trokan '942 published application discloses the triangular arrangement of the drinking cups used and the general size of the playing field used, it does not describe the playing field particularly adapted for use with the game.

"Flip Cup" is another drinking game that is played in many of the same venues as "Beer Pong". In "Flip Cup", two opposing teams line up across from each other at a table. Each player has a cup, filled with a beverage. Starting at one end of the table, the first player on each team consumes the beverage in his cup and places the emptied cup, upright, along the table edge, with a portion of the cup bottom extending over the edge. The player strikes this portion of the cup bottom from below, attempting to flip the cup into an upside down position on the table. If the attempt is unsuccessful, the player places the cup again and repeats the flip attempt until successful. The game proceeds in the manner of a relay race, with each team member starting only after the prior team member has succeeded. The first team to successfully drink and flip all of its cups is the winner.

As with Beer Pong, Flip Cup can become very messy due to inadvertent spillage. The ability to contain such spillage on the table is desirable. Even in a commercial drinking establishment, it is desirable to have a portable playing surface for playing games such as Beer Pong and/or Flip Cup, so that the playing surface may be readily moved for cleaning and be readily stowed away when not in use.

It is therefore an unmet advantage for the prior art to provide a compact and portable standardized playing surface for drinking games such as Beer Pong and/or Flip Cup that is readily portable and easily cleaned after use.

None of the above listed U.S. patents applications disclose or suggest an omni-directional and/or multi-level beer pang gaming surface of the present invention. Each of the above listed U.S. patents applications (i.e., US 2005/0029747 A1; and US 2004/0188942 A1) are hereby incorporated herein by reference.

SUMMARY OF THE INVENTION

The forgoing problems and limitations are overcome and other advantages are provided by a new and improved beer pong gaming table which provides flexibility and user convenience when setting up and storing in inconvenient and confined venues.

Therefore, it is an object of the present invention to provide a novel beer pong gaming table and/or target system enabling rapid play.

The present invention provides a multi-level table game assembly comprising a lower table forming a substantially circular upwardly facing playing surface and a circumferentially continuous outwardly facing edge having a nominal diameter D1, an upper table forming a substantially circular upwardly facing playing surface, a bottom surface and a circumferentially continuous outwardly facing edge having a nominal diameter D2, wherein D1>D2, a vertically elongated support member rigidly interconnecting the upper and lower tables, wherein playing surfaces each define discrete play segments and cup positioning markers. This arrangement provides an extremely compact game assembly suitable for tailgate venues and the like.

According to one aspect of the invention, a table game assembly includes a table forming a substantially circular upwardly facing playing surface and a circumferentially continuous outwardly facing edge, an inner circular hub line extending about the axial center of said playing surface, a plurality of radially outwardly directed rays formed on said playing surface, each said ray circumferentially equally spaced from each immediately adjacent ray, wherein each pair of adjacent rays defines a generally trapezoidally shaped play segment extending from said edge to said hub line, an outer cup positioning marker centrally formed in each play segment at a common radial distance from said edge, and an inner cup positioning marker centrally formed in each play segment at a common radial distance from said hub line.

According to another aspect of the invention, A table game assembly comprises a first table forming a substantially circular upwardly facing playing surface and a circumferentially continuous outwardly facing edge having a nominal diameter D1, a second table forming a second substantially circular upwardly facing playing surface, a bottom surface and a circumferentially continuous outwardly facing edge having a nominal diameter D2, wherein D1>D2, a vertically elongated support member rigidly interconnecting the first table playing surface with the second table bottom surface, said first and second playing surfaces each including an inner circular hub line extending about the center of said respective playing surface, said first and second playing surfaces each including a plurality of radially outwardly directed rays formed on said respective playing surfaces, each said ray circumferentially equally spaced from each immediately adjacent ray, wherein each pair of adjacent rays defines a generally trapezoidally shaped play segment extending from said edge to said hub line, an outer cup positioning marker centrally formed in each play segment at a common radial distance from said edge, and an inner cup positioning marker centrally formed in each play segment at a common radial distance from said hub line.

According to yet another aspect of the invention, the table game assembly further comprises at least one open topped drinking container including a side wall and a generally circular bottom wall, wherein said bottom wall has a nominal diameter of D, wherein said outer cup positioning marker within a given play segment is located radially from said edge by a dimension R, and wherein D>R. This arrangement ensures that cups positioned to ensure that they overlap the outer edge of the table edge, allowing playing "Flip Cup" simultaneously with "Beer Pong"

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Although the drawings represent various embodiments and features of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENTS

The present invention, although conceivably useful indoors, is primarily intended for outdoor use. Specifically, it is intended for outdoor venues such as athletic contests (e.g. football games) where large groups of spectators gather in a celebratory atmosphere. "Tailgating" is a tradition at such events where fans congregate to eat, drink and socialize (e.g. play team-type games) prior to athletic contest.

The preferred embodiment is described for use in conjunction with attendance at a football game, and particularly for games involving a particular sports team. To this end, it can include team specific features such as logos, team colors, mascot persona, and the like. Such features are included for exemplary purposes only.

Figure 1:
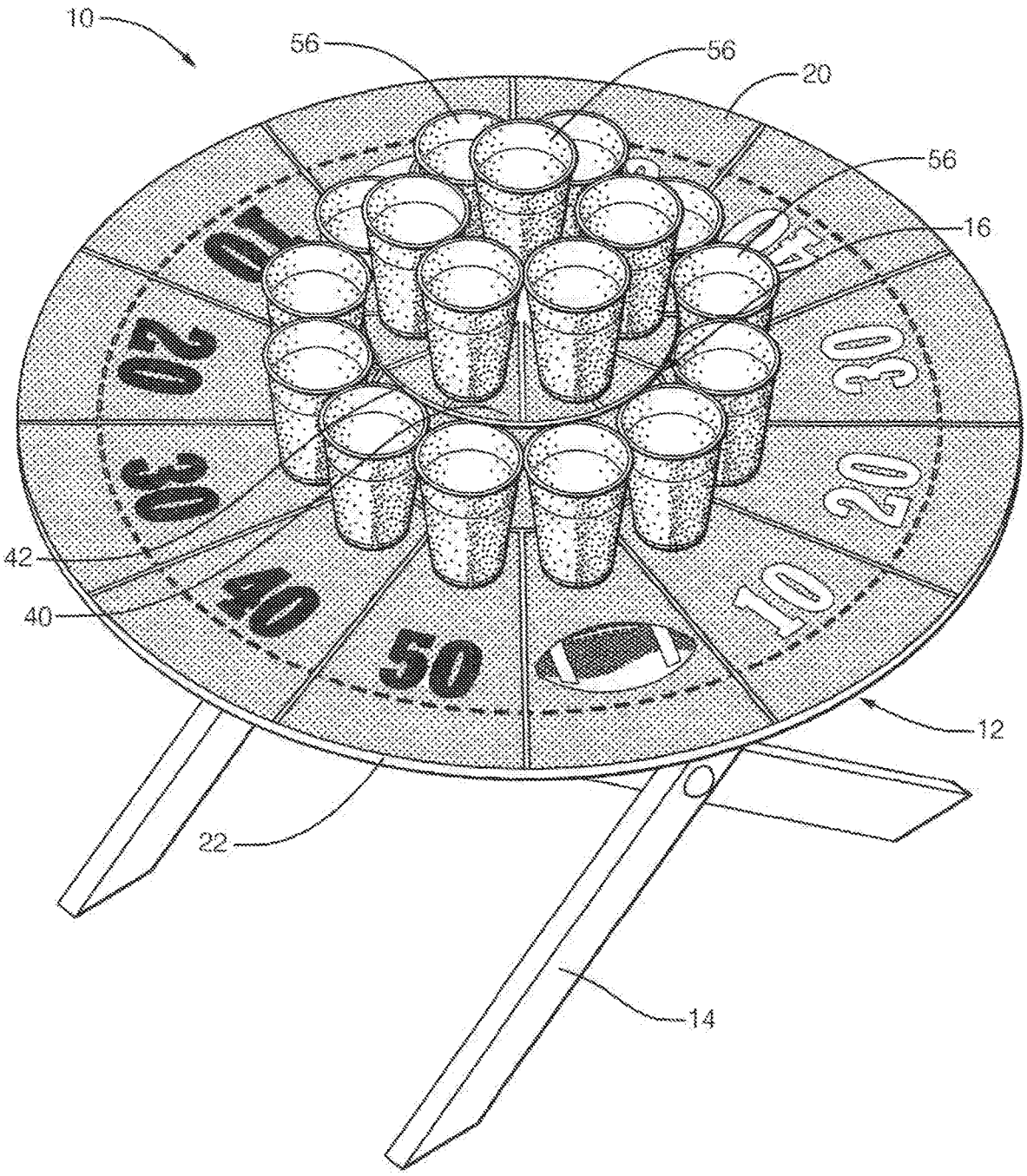
FIG. 1, is a downwardly directed perspective view of a reconfigurable TailSports game table assembly embodying the present invention, deployed for a "Tail Pong" game, the TailSports game table assembly including a one-piece lower or main table portion supported on a folding leg structure, an upper table portion symmetrically supported above the lower table portion by centered pedestal, and a plurality of beverage glasses prepositioned on designated upper surface areas of both the main and upper table portions.
Figure 8:
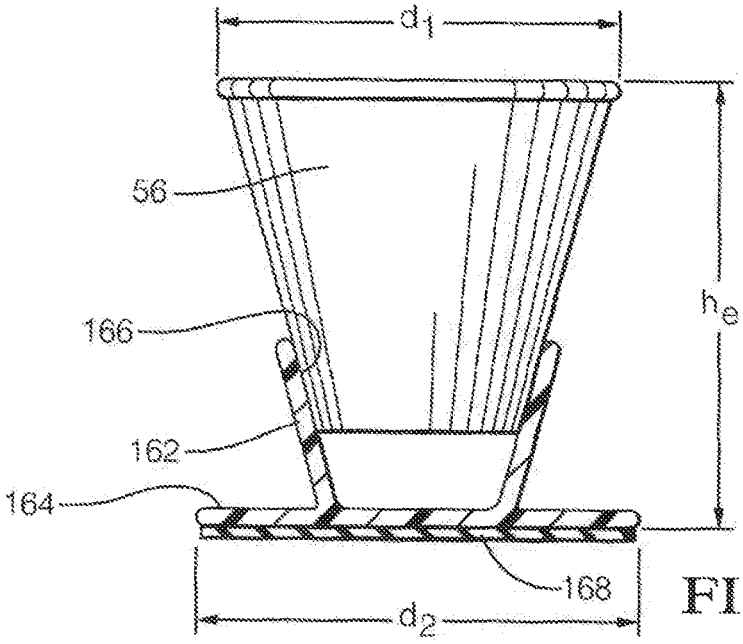
FIG. 8, is a cross-sectional view of a cup height extender which can be employed to selectively vertically position and affix a game cup to the upper or lower table portions of the TailSports game table assembly with certain game configurations.
Figure 9:
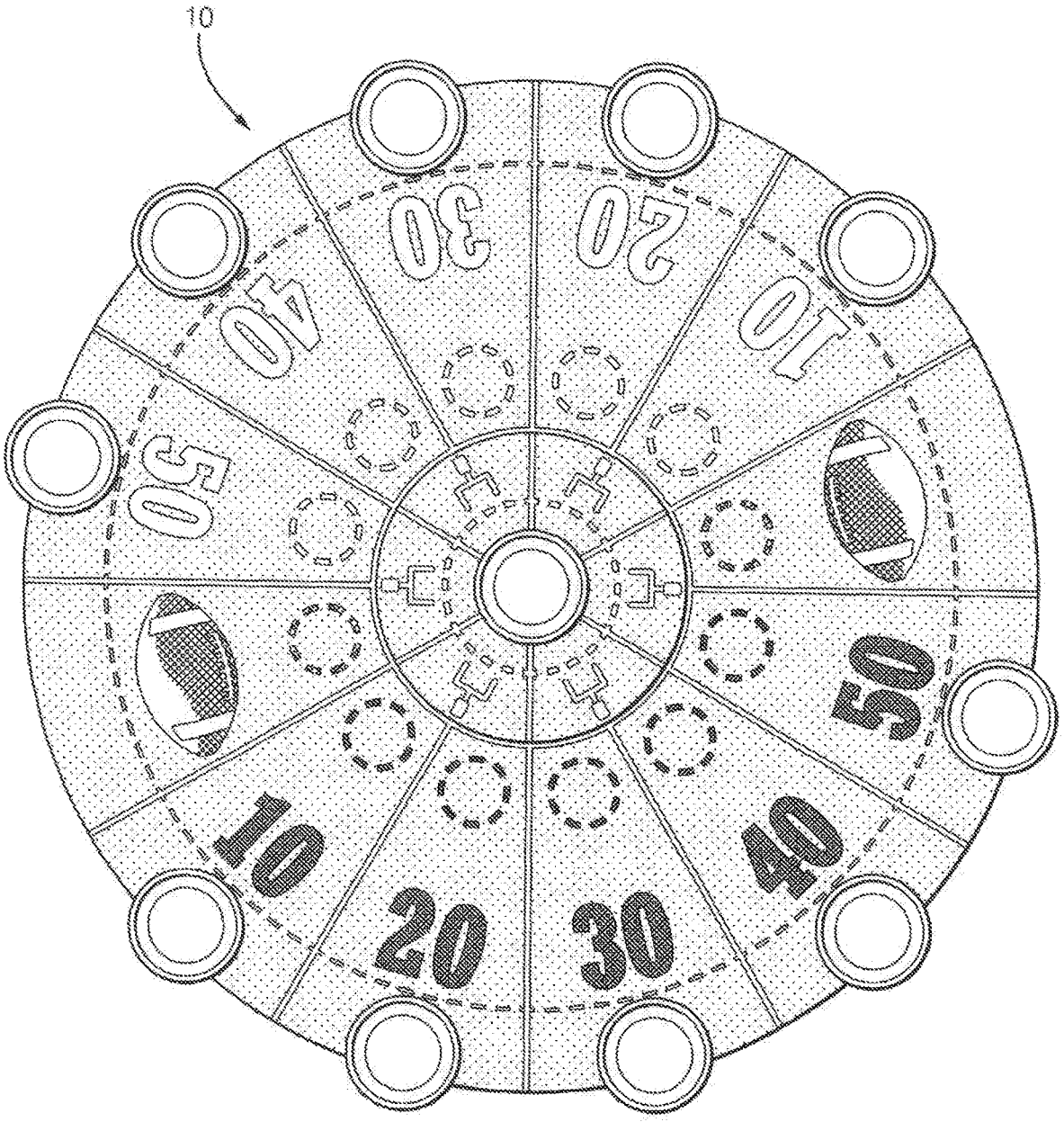
FIG. 9, is atop plan view of the TailSports game table assembly of FIG. 1 with the game cups initially arranged for a first game sequence.

Referring to the drawing figures, and particularly to FIGS. 1, 8 and 9, a preferred embodiment of a game table assembly (in use) in accordance with the present invention is illustrated in perspective view and is generally designated by the reference numeral 10.

Figure 2:
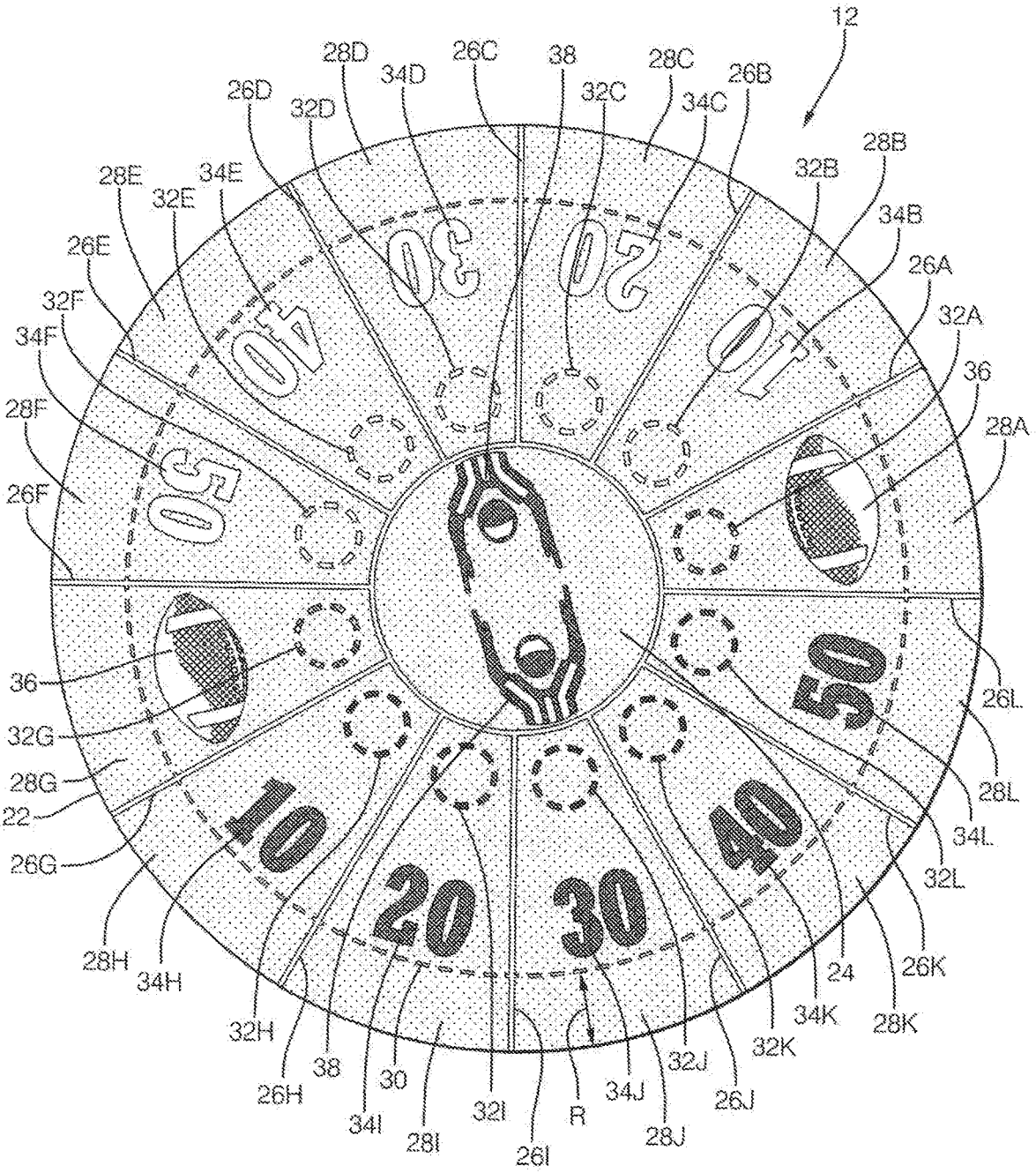
FIG. 2, is a top plan view of the lower table portion of the TailSports game table assembly of FIG. 1 on an enlarged scale.
Figure 3:
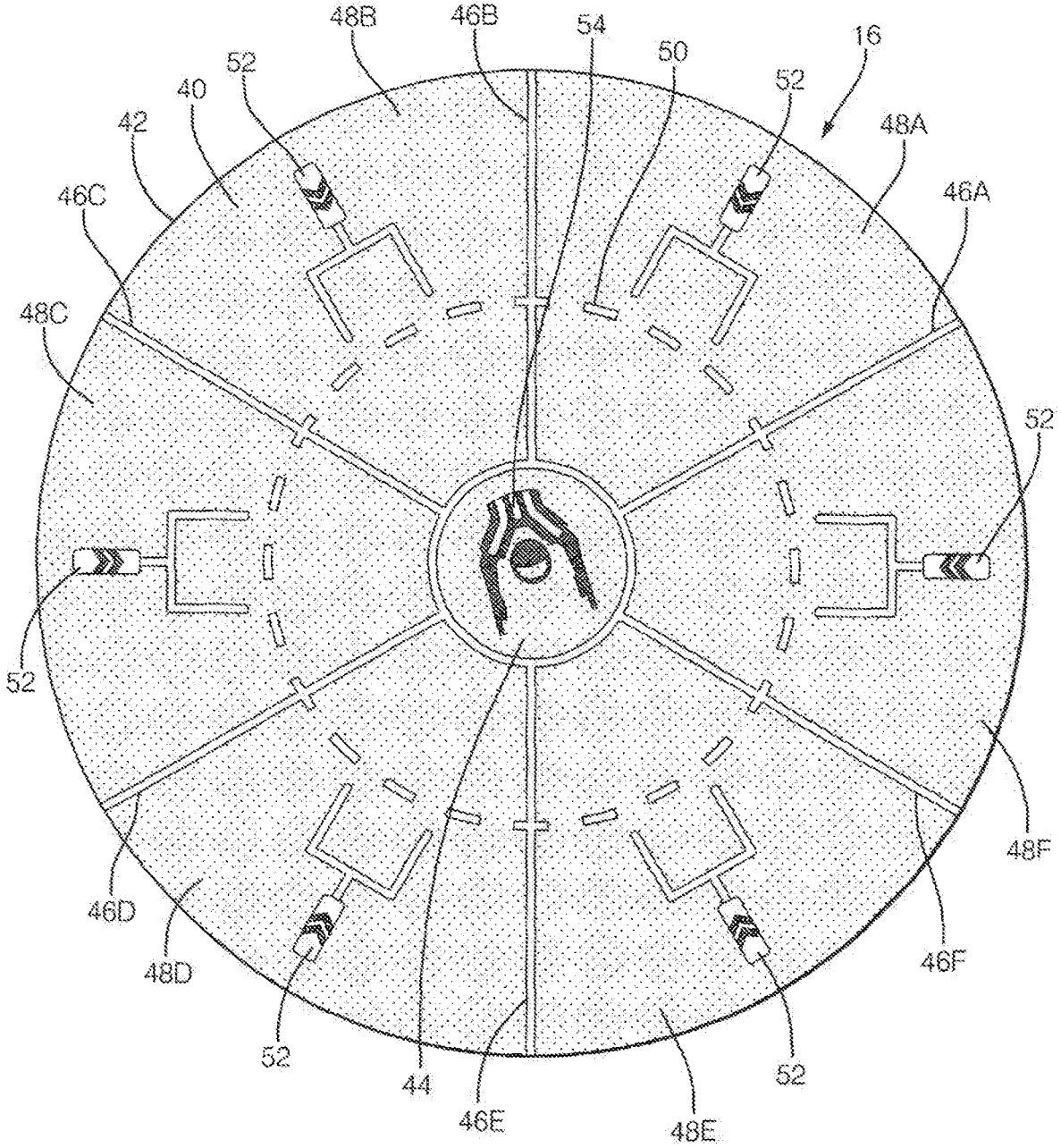
FIG. 3, is a top plan view of the upper table portion of the TailSports game table assembly of FIG. 1 on a still further enlarged scale.

Referring to FIGS. 1-3, a first embodiment of a game table assembly 10 includes a first or bottom table 12 supported on a folding leg assembly 14 affixed to the lower surface (not illustrated) thereof. A second or top table 16 is arranged concentrically above the bottom table 12 and is retained in a fixed position by a vertically elongated support member (not illustrated). The tables 12 and 16 can be fabricated from composite material such as plywood which is subsequently painted, but preferably are injection or blow molded from plastic with the artwork integrated therein.

FIG. 2 illustrates the detail of the playing surface 20 of the bottom table 12, which is decorated and colored in a football motif. The design can be altered depending upon the activity, sport, team or the like. The bottom table 12 is round and 36 inches in diameter ($D_1$) and forms a circumferentially continuous outwardly facing edge 22. The playing surface 20 is illustrated in a green color with a circular hub 24 defined by a concentric line. Twelve equally spaced circumferential radial lines or rays 26A-26L extend from the hub 24 to the outer edge 22. Each adjacent pair of rays 26A-26L are angularly offset by 30°. Rays 26A-26L and captured portions of the hub 24 and outer edge 22 define twelve equally dimensioned trapezoidally shaped play segments 28A-28L. An outer cup positioning marker 30 is illustrated as a dotted circle concentric with the playing surface 20 located inwardly from the outer edge 22 by a radial dimension R which is less that the nominal diameter D of the bottom of a cup employed in a game to ensure that a portion of the cup extends radially outwardly beyond the outer edge 22. An inner cup positioning marker 32A-32L is illustrated is a small dotted circle centrally disposed within each play segment 28A-28L located radially outwardly from the central hub 24.

Play segments 28B-28F segments are reserved for Team 1, play segments 28H-28L are reserved for Team 2 and play segments 28A and 28G provide an unused free space between the teams. Scaled indicia such as white colored consecutive yardage marker designations "10", "20", "30", "40" and "50", 34B, 34C, 34D, 34E, and 34F, respectively, are disposed within associated play segments 28B-28F, respectively. Similarly, scaled indicia such as black colored consecutive yardage marker designations "10", "20", "30", "40" and "50" are disposed within associated play segments 28H-28L, respectively. Game themed indicia such as footballs 36 are disposed within play segments 28A and 28G. Game themed indicia such as stylized referee FIG. 38 are disposed within the circular hub 24.

FIG. 3 illustrates the detail of the playing surface 40 of the top table 16, which is decorated and colored in a football motif. The design can be altered depending upon the activity, sport, team or the like. The top table 12 is round and 12 inches in diameter (D2) and forms a circumferentially continuous outwardly facing edge 42. The playing surface 40 is illustrated in a green color with a circular hub 44 defined by a concentric line. Six equally spaced circumferential radial lines or rays 46A-46F extend from the hub 44 to the outer edge 42. Each adjacent pair of rays 46A-46L are angularly offset by 60°. Rays 46A-46L and captured portions of the hub 44 and outer edge 42 define six equally dimensioned trapezoidally shaped play segments 48A-48F. An outer cup positioning marker 50 is illustrated as a dotted circle concentric with the playing surface 40 located inwardly from the outer edge 42. Circular hub 44 defines an inner cup positioning marker illustrated is a small solid circle.

Play segments 48A-48C segments are reserved for Team 1, and play segments 48D-48F are reserved for Team 2. Game themed indicia such as goalposts 52 are disposed within each play segment 48A-48F. Game themed indicia such as a stylized referee FIG. 54 is disposed within the circular hub 44.

Once the game table assembly 10 is assembled as illustrated in FIG. 1, each ray 46 of the top table 16 aligns in parallel with every other ray of bottom table 12. For example, if upper ray 46A is aligned with lower ray 26A, upper ray 46B will align with lower ray 26C, upper ray 46C will align with lower ray 26E, upper ray 46D will align with lower ray 26G, upper ray 46E will align with lower ray 26, and upper ray 46F will align with lower ray 26K. Restated, when so aligned, upper play segment 48A encompasses and is thus part of both lower play segments 28B and 28C, upper play segment 48B encompasses and is thus part of both lower play segments 28D and 28E, upper play segment 48C encompasses and is thus part of both lower play segments 28F and 28G, upper play segment 48D encompasses and is thus part of both lower play segments 28H and 28I, upper play segment 48E encompasses and is thus part of both lower play segments 28J and 28K, and upper play segment 48F encompasses and is thus part of both lower play segments 28L and 28A. The forgoing juxtaposition of the bottom table 12 and the upper table 16 is best illustrated in FIGS. 8 and 9.

Referring to FIG. 1, a number of disposable plastic cups 56 are employed in various numbers and configurations for the games described herein. Examples of two specific alternative configurations are illustrated in FIGS. 8 and 9.

The most common cups used are 18 fluid ounce (530 ml) disposable plastic cups 54 (such as red Solo brand cups) with ridge-lines which can be used precisely to measure the amount of beverage (beer) to be poured into the cup. Prior to commencing a game, cups are positioned on each play segment 28A-28-L on play surface 20 and 48A-48F on play surface 40. Each team usually also has a separate cup of water used to rinse off the balls.

Although 18 ounce cups 56 are very common in games of this nature, other sized disposable cups, as listed below, can be employed:

| CUP VOLUME (oz.) | HEIGHT | RIM DIA. | BASE DIA. (all in.) |
|---|---|---|---|
| 18 | 4.750 | 3.750 | 2.500 |
| 14 | 4.500 | 3.375 | 2.375 |
| 12 | 4.500 | 3.250 | 2.375 |
| 9 | 3.750 | 3.000 | 1.875 |
| 5 | 2.750 | 2.500 | 1.750 |
| 2 | 2.125 | 2.000 | 1.250 |

Because different sized cups 56 may be employed for various games and circumstances, the configuration of the outer cup positioning markers 30 and 50, and the inner cup positioning markers 32 and 44 can be varied. Because differing base diameter cups may be employed, a plurality of concentric or non-concentric circles (solid, dotted or otherwise) such as a shooting target can be employed to assist precise location of cups 56.

Figure 4:
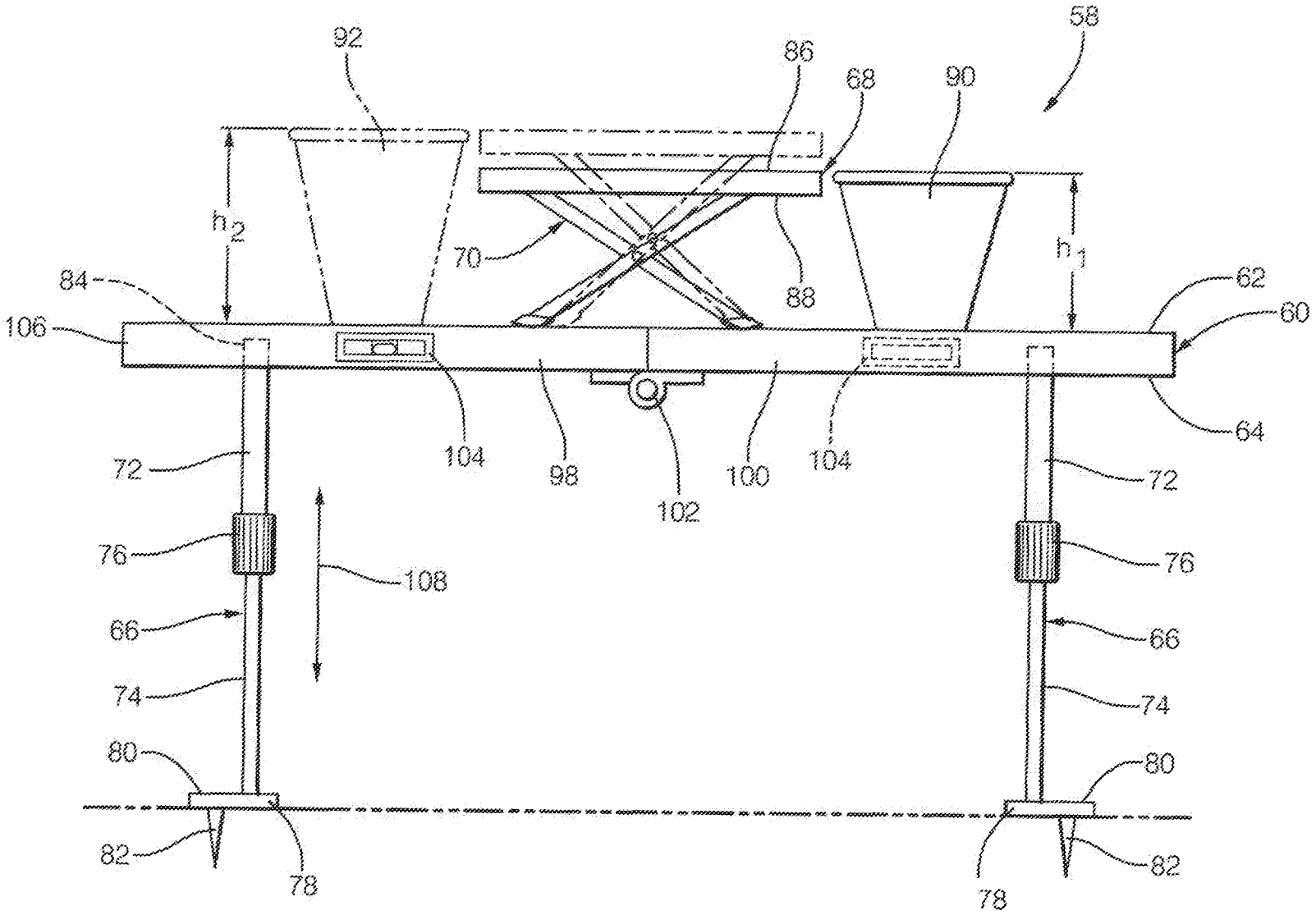
FIG. 4, is a side plan view of a reconfigurable TailSports game table assembly including an alternative embodiment of the present invention, featuring a bi-foldable lower table portion supported upon discrete vertically adjustable ground staking legs and an infinitely adjustable scissors frame interconnecting the lower and upper table portions.

Referring to FIG. 4, an alternative embodiment of the present invention includes a game table assembly 58 including a first or bottom table 60 having an upper playing surface 62 and a bottom surface 64. The game table assembly 58 is supported by a plurality (preferably 4) of tubular legs 66 circumferentially equally spaced about the perimeter of the bottom table 60. A second or top table 68 having an upper playing surface 86 and a bottom surface 88 is supported above the bottom table 60 by a scissors spacer or adjuster 70 which is infinitely or incrementally adjustable within a fixed range of displacement. As illustrated, the upper playing surface 86 of the top table 68 is positioned above the upper playing surface 62 of the bottom table 60 by a vertical dimension $h_1$ corresponding with the nominal height of a cup 90 employed in a game. If a larger cup having a greater nominal height is to be employed in a game, the scissors adjustor 68 is reconfigured wherein the upper playing surface 86 of the top table 68 is positioned above the upper playing surface 62 of the bottom table 60 by a vertical dimension $h_2$ corresponding with the nominal height of a taller cup 92.

As an alternative to the scissors adjuster 70, a fixed length or adjustable free-standing column can be applied to interspace the top table 68 above the bottom table 60.

The bottom table is bifurcated onto two mirror image halves 98 and 100 joined by a piano type elongated hinge 102. At least one spirit level device 104 is integrated within the outer edge 106 of the lower table to facilitate set-up of the game table assembly 58 on even ground. Preferably two such spirit level devices 104 are circumferentially of let by 90° to enable two-axis leveling.

Each tubular leg 66 includes an upper tube portion 72 telescopingly disposed within a lower tube portion 74 and selectively engaged by a cinching collar 76. Each leg 66 is removably connected to the bottom surface 64 of table 60 wherein the upper end of each upper tube 72 is slip fit or screwed within a blind bore opening 84 (illustrated in phantom) formed in the bottom surface 64 of the bottom table 60. The lower end of lower tube 74 terminates in a foot 78 forming an outwardly extending offset 80 and a ground engaging spike 82. The axial length of each leg 66 can be separately adjusted, as illustrated by arrow 108, to accommodate uneven ground.

Referring to Figures SA. 5B and 5E, a scissors type adjustable spacer 70 includes two pairs of elongated struts 94 and 96, each pair juxtaposed in an "X" configuration and for rotation about a central axis A-A. The pairs of struts 94, 96 are axially separated by a tubular spacer 110 and held in assembly by opposed hand tightening knobs 112 having opposed threaded shafts 114 extending through thru bores 116 and 118, and threadably engaging a threaded center shaft 120 of spacer 110.

Figure 5A:
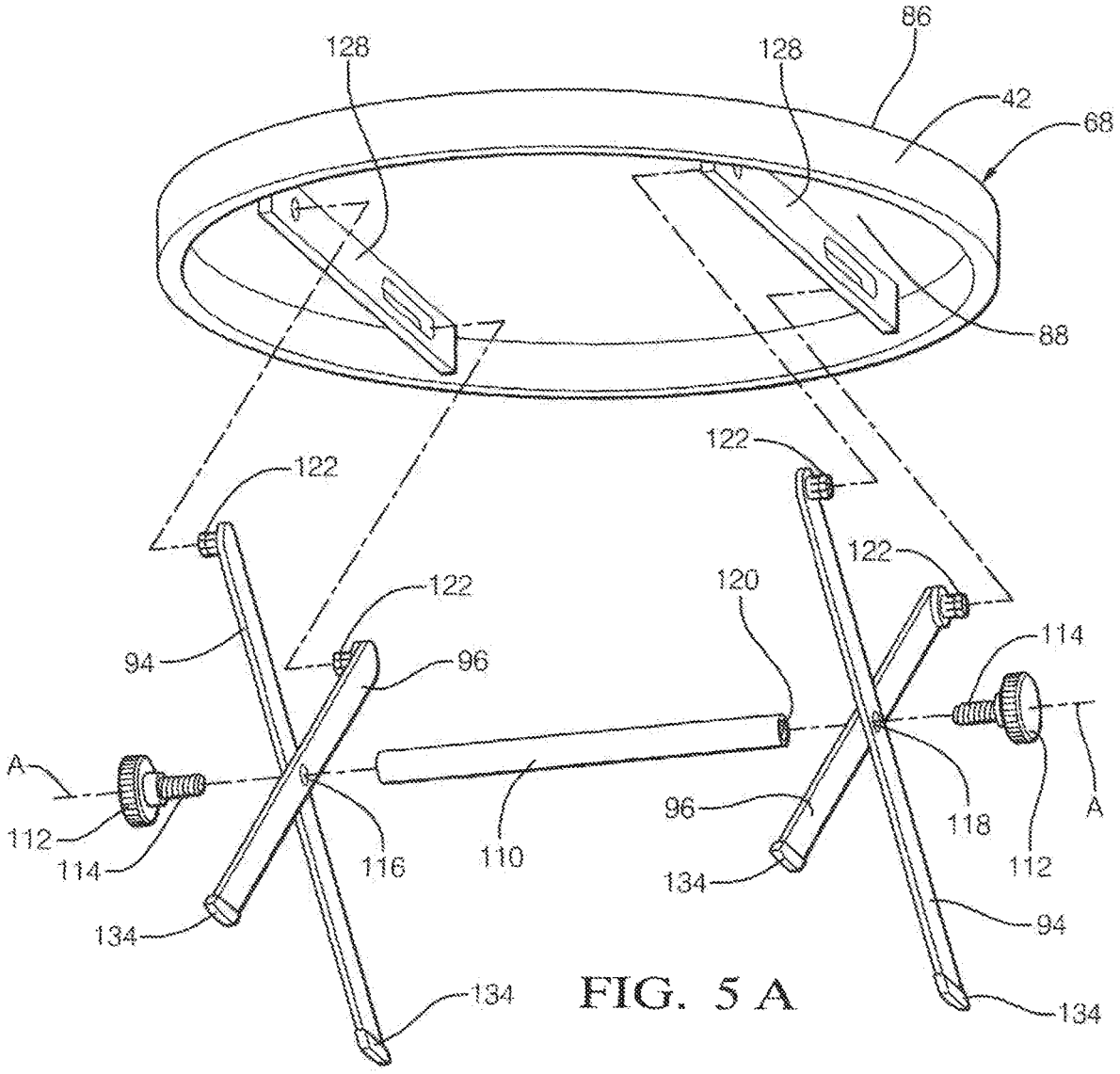
FIG. 5A, is an exploded perspective view of the an infinitely adjustable scissors frame and upper table of FIG. 4 on an enlarged perspective.
Figure 5B:
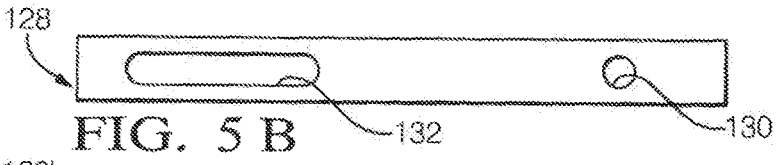
FIG. 5B, is side view on an enlarged scale of a subframe integrated or interfit on the bottom of the upper table of FIG. 5A enabling infinite adjustability of the scissors frame within a limited range.
Figure 5C:
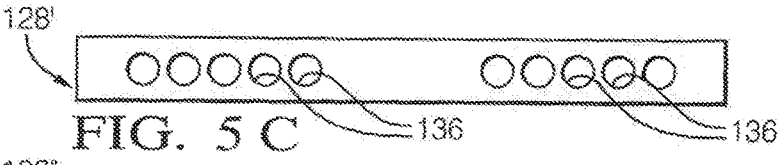
FIG. 5C, is side view on an enlarged scale of an alternative design subframe integrated or interfit on the bottom of the upper table of FIG. 5A enabling coarsely stepped adjustability of the scissors frame within a limited range.
Figure 5D:
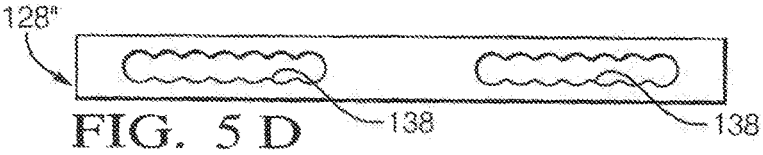
FIG. 5D, is side view on an enlarged scale of a second alternative design subframe integrated or interfit on the bottom of the upper table of FIG. 5A enabling finely stopped adjustability of the scissors frame within a limited range.
Figure 5E:
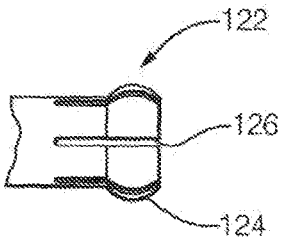
FIG. 5F, is a broken plan view, on an enlarged scale of an exemplary radially resilient connector integrally formed near the end of each scissors frame element retentively interconnected within an opening of a subframe of the upper table.

An outwardly projecting pivot extension 122, as detailed in FIG. 5E, is integrally formed adjacent the upper end of each strut 94, 96. Each pivot extension 122 is generally tubular in form, terminating in a bulbous end portion 124 which is circumferentially segmented by a plurality of axial slots 126 affording radial resilience.

Referring to FIGS. 5A and 58, a support bracket 128, associated with each scissors adjuster 70, is located along the bottom surface 88 of the top table 68 and entrained by the inner surface of the outer edge 42 of the top table 68. Each support bracket 128 is elongated and has a thru bore 130 and a thru slot 132 formed at opposed ends thereof. Each scissors adjuster 70 is assembled with an associated support bracket 128 by extending its pivot extensions 122 through the bore 130 and slot 132. The bulbous end portion 124 has a nominal diameter slightly larger than the diameter of the thru bore 130 and slot 132 requiring temporary resilient deflection of the segments to enable assembly. Thereafter, the struts 94 and 96 are selectively rotationally repositioned to affect the desired vertical height of the combined scissors adjuster 70 and top table 68. When so positioned, the knobs 112 are tightened to affix the scissors adjuster 70 in their desired configurations.

The lower end of each strut 94, 96 preferably includes a resilient (e.g., rubber) cleat or foot 134 to provide tactile adhesion with the playing surface 62 of the bottom table 60 without marring during usage. Alternatively, a form of mechanical interconnection of the struts 94, 96 to the upper (playing) surface of the lower table 60 can be implemented.

Referring to FIG. 5C, a series of spaced apart thru holes 136 are formed adjacent each end of the support bracket 128' providing coarse incremental adjustability. Referring to Figure SD, a series of overlapping thru holes 138 are formed adjacent each end of the support bracket 128" providing relatively fine incremental adjustability.

The major components of the game table assembly 58 are preferably formed of lightweight rigid material, such as fiberglass or vacuum formed plastic. The support brackets 128 can be discrete elements or, alternatively, can be integrally formed with their associated top table 68.

The bottom table 60 is dimensionally identical to bottom table 12 and the playing surface 62 is as described in connection with FIG. 2. The top table 68 is dimensionally identical to bottom table 16 and the playing surface 62 is as described in connection with FIG. 3.

Figure 6:
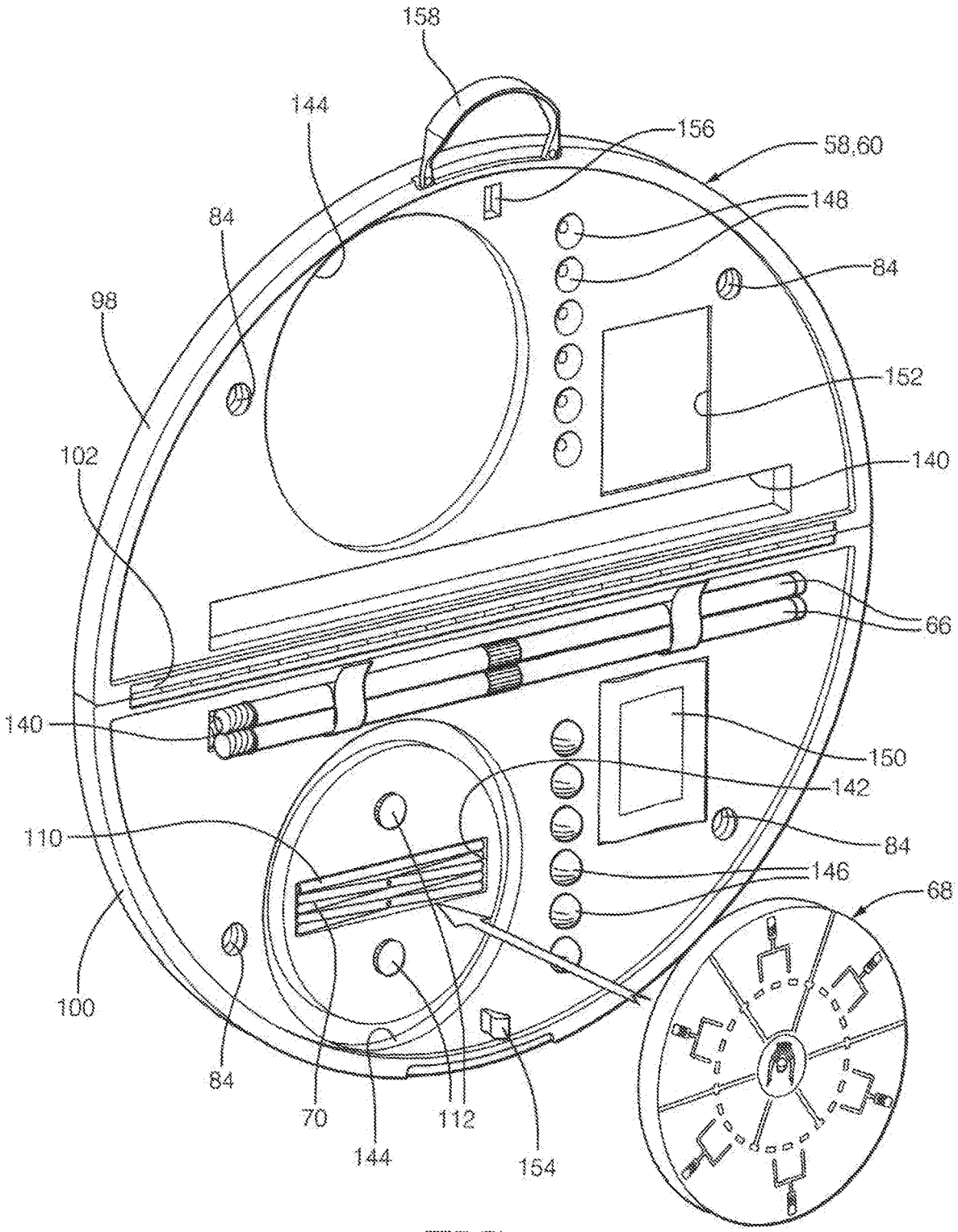
FIG. 6, is an exploded, perspective bottom view of the reconfigurable TailSports game table assembly of FIG. 4 on an enlarged scale illustrating additional features including internal stowage of the upper table portion, game balls, the scissors frame and the lower table legs within the lower table portion.

Referring to FIG. 6, the game table 58 is illustrated with each discrete or removable element disassembled and stowed in associated retention pockets formed in the bottom surface 64. Specifically, the four legs 66 are removed from their blind bores 84, collapsed to a minimum axial length, bundled and stowed within an elongated recess 140. Note that the foot 78 and spike 82 structure are not illustrated for the purpose of clarity in FIG. 6. The scissor adjusters 70, support brackets 128, tubular spacer 110 and knobs (2) 112 are separated and stowed in associated retention pockets 142. The top table 68 is stowed within an associated round recess 144. Individual ping pong balls 146 are stowed within separate retention pockets 148. Lastly, a rule book instruction manual 150 is stowed within a retention pocket 152. Note that designated recesses 140, 144, 148 and 152 are mirrored in clam shell fashion in table halves 98 and 100.

Figure 7:
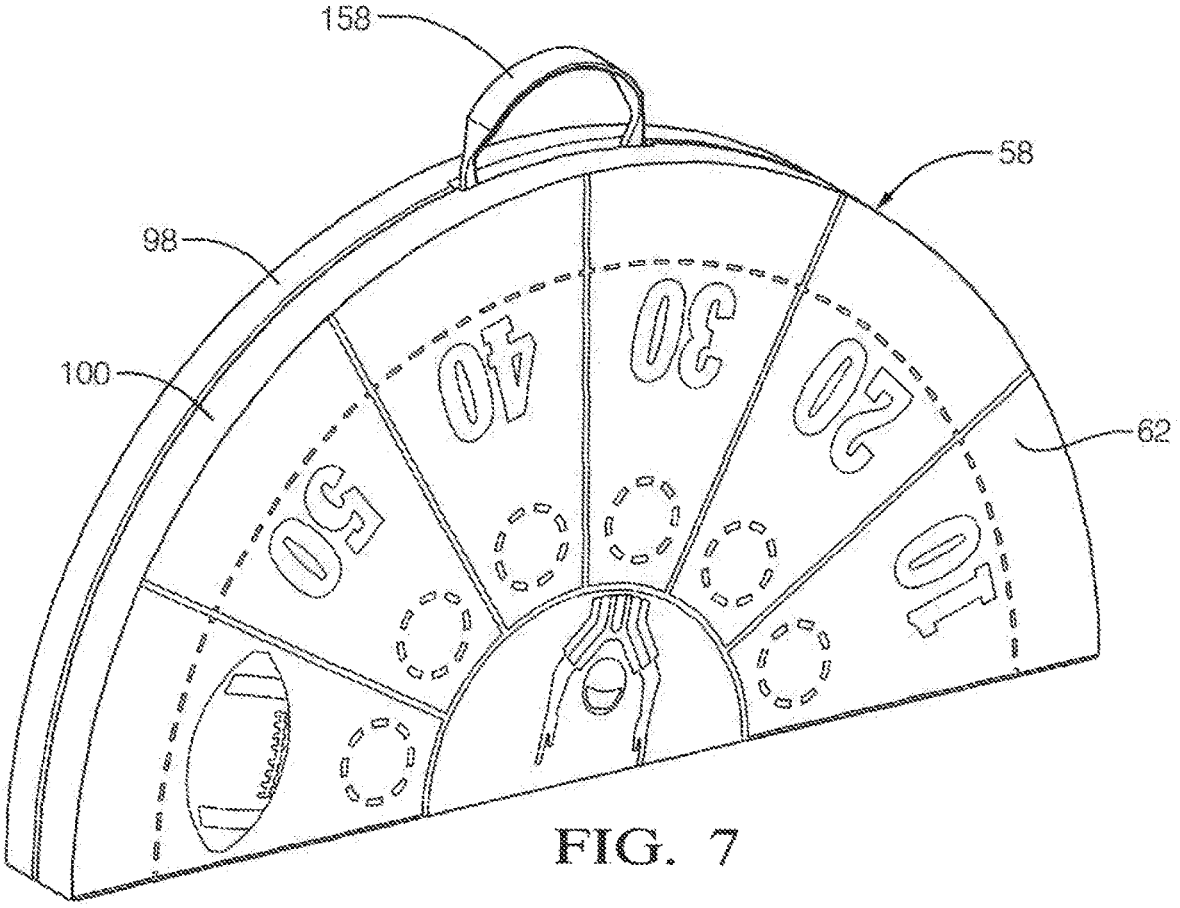
FIG. 7, is a perspective view of the game assembly of FIG. 6 in the fully folded configuration for stowage and/or transportation to a game venue.

The bottom table 60 also forms a cooperating latch 154 and catch 156, to retain the table 60 in a closed position as illustrated in FIG. 7, and a carrying handle 158. For additional protection, the game assembly 58 can be provided with a zippered cover carrying case (not illustrated).

Referring to FIG. 8, for game configurations, such as illustrated in FIG. 1, the cup 56 positioned in the center of the top table 16 within the circular hub 44 is elevated above the surrounding cups 56 adjacent the outer cup positioning marker 50. This is accomplished by employing a cup height extender 160 comprising an upwardly opening cylindrical wall 162 and an integral radially outwardly extending flanged base 164. The cylindrical wall 162 defines an inner wall surface 166 which is tapered at substantially the same pitch as the nominal outer wall of the intended cup 56. This effectively increases the effective height ($h_e$) of the cup 56 (approximately 3 inches) while maintaining its standard lip diameter ($d_1$) and provides extremely robust retention of the cup 56, even when filled with a liquid. The flanged base 164 has a flat bottom with an effective nominal diameter ($d_2$). Stability if the elevated cup 56 can be further enhanced by the addition of an adhesive or tactile layer. This feature provides a third level (of lips of cups in play).

The basic rules of two exemplary games: Game 1: Tail Pong and Game 2: Race Pong are as follows.

Tail Pong Rules:

The object of the game is to finish each task in order before the opposing team finishes their task.

Each team is made up of 1-5 players

First Sequence:

(A.) You start by lining your Solo cup 56 face up on the outside of the dotted circle 30 filled with ⅓ liquid as illustrated in FIG. 9.

(B.) The game starts with the first person on each team at the 10 yard line 28B and 28H.

(C.) The first person drinks the contents of their cup 56, and then places the cup down on the edge 22 of the table 20.

(D.) The player then flips over the "flip cup" until the cup 56 lands on its lip/top. The next player will only get to their turn once each subsequent player finished their task and so on.

(E.) When each player on your team drinks the contents of their cup 56, then flips the cup 56 over with the lip landing on the table 20, the team then advances to their next task.

Figure 10:
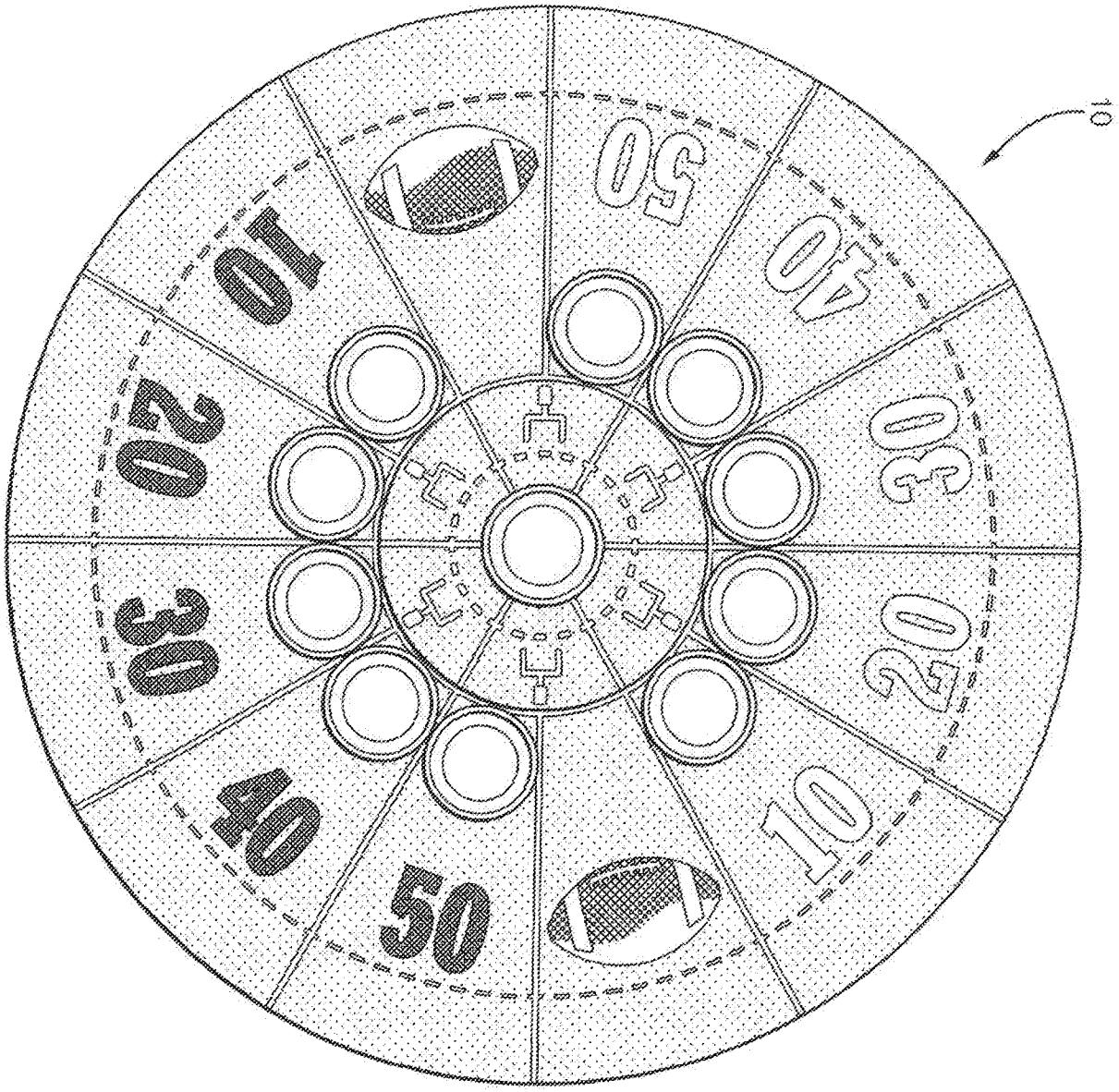
FIG. 10, is a top plan view of the TailSports game table assembly of FIG. 1 with the game cups initially arranged for a second and third sequence game.

Second Sequence:

(A.) Each player, lines their cup 56 up on the inside circle 32 as illustrated in FIG. 10.

(B.) Once the cups 56 are lined up on the inside circle 32, the person starting at the 10 yard line 28B or 28H takes a ping-gong ball 146 and bounces the ping-pang ball 146 into their cup 56. Once the player bounces the ping-pong ball 146 into the cup 56, the next player in line will do the same and so on.

Third Sequence:

(A.) When all of the players achieve getting the ping-pong ball 146 in their cups in sequence, the ping pong ball 146 is given back to the first player at the 10 yard line 28B or 28H.

(B.) The first player, then attempts to bounce the ping-gong ball 146 from the first level to the second level into the top cup 56. If this player does not get the ping-pong ball 146 into the top cup 56, the ping-pong ball 146 will be given to the next player in line for their chance at bouncing the ping-pong ball 146 into the cup 56. Once one of the teams finishes their entire task and one of the teams bounces the ping pong ball 146 into the top center cup 56. The person on the opposing team whom is in play "bouncing their ping-pong ball 146" will have to drink the entire contents of the top center cup 56.

Race Pong Rules (A.) Divide into two equal teams from 1 to 5 people.

(B.) Fill up each cup 56 with about ⅓ drink and 1 cup 56 in the center top full of drink.

(C.) The first person at the 50 yard line 28F or 28L starts the game.

(D.) You start the game by drinking the ⅓ drink, then flipping the cup 56 over and having it land on its rim, face down. Once your cup 56 is successfully flipped over, the team member to your left at the next lower yard line drinks their drink and flips their cup 56 over, and so on.

(E.) Once all the cups 56 on your team have been drunk and flipped over, the process starts again with the first person at the 50 yard line.

(F.) The next sequence is you have to place your cup 56 upright on the dashed circle 32, then bounce a ping pong ball 146 into your cup 56. Once you bounce your ping pong ball 146 into your cup 56, then the next person at the next lower number to your left does the same. When all players on your team get the ping pong ball 146 into their cup 56, the ping pong ball 146 goes back to player number one.

(G.) The final sequence is to bounce the ping pong ball 146 into the full cup 56 of drink in the center of the board 16. The first team to achieve all of the sequences wins! When a team wins, the contents of the center cup 56, has to be drunk by the opposing team member that is attempting the sequence.

Figure 11:
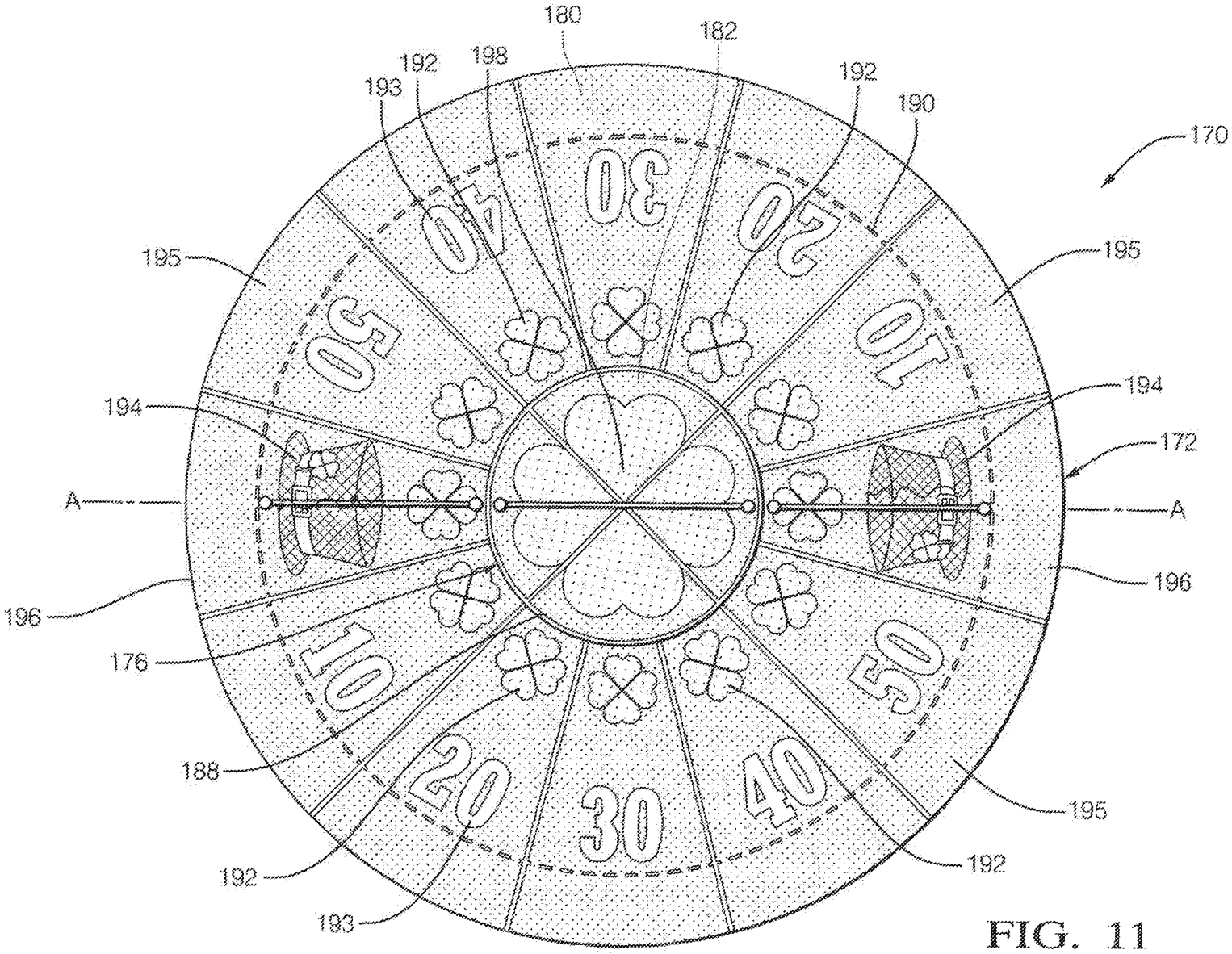
FIG. 11, is a top plan view of an alternative embodiment of the present invention, structured similarly to that depicted in FIGS. 1-3, but with more rigid construction appropriate for semi-permanent or indoor use, with an entirely different (non-sport related) decorative motif, and the addition of a net system bifurcating the playing surfaces between the teams to prevent a bouncing ping pong ball from intruding into an opponent's field of play and to enable simultaneous play by multiple teams without significant interference with one another.
Figure 12:
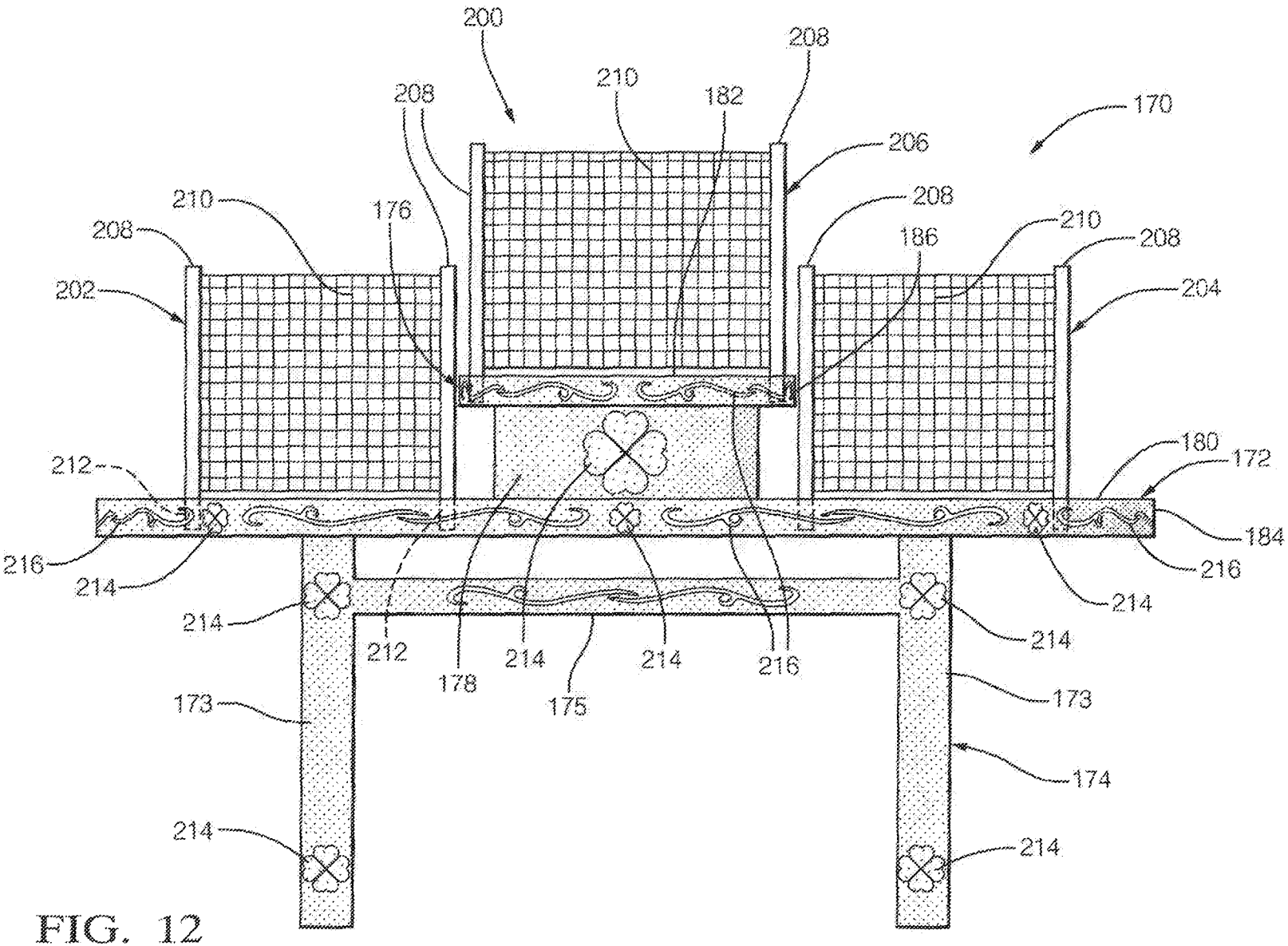
FIG. 12, is a side plan view of the alternative embodiment of FIG. 11, illustrating the net system and the extension of the decorative motif to the table edges, the vertical support member, legs and support structure.

Referring to FIGS. 11 and 12, a second embodiment of a game table assembly 170 includes a first or bottom table 172 supported on a rigid fixed leg assembly 174 affixed to the lower surface (not illustrated) thereof. The leg assembly 174 includes a plurality (such as 4) circumferentially spaced legs 173 and a plurality (such as 4) of cross members 175 interconnecting adjacent leg pairs 173. A second or top table 176 is arranged concentrically above the bottom table 172 and is retained in a fixed position by a vertically elongated support member 178. The tables 172 and 176 can be fabricated from composite material such as plywood which is subsequently painted, but preferably are injection or blow molded from plastic with the artwork integrated therein.

FIGS. 11 and 12 illustrate the detail of a playing surface 180 of the bottom table 172 and a playing surface 182 of the top table 176, which are decorated and colored in an Irish/St. Patrick motif. The design can be altered depending upon the theme, activity or the like. Tables 172 and 176 are round and form circumferentially continuous outwardly facing edges 184 and 186, respectively. The playing surfaces 180 and 182 are illustrated in a dark green color with a circular hub 188 defined by a concentric line. Twelve equally spaced circumferential radial lines or rays, similar to rays 26A-26L of FIG. 2 extend from the hub 188 to the outer edge 172. An outer cup positioning marker 190 is illustrated as a dotted circle concentric with the playing surface 180 located inwardly from the outer edge 184. Similarly, four equally spaced circumferential radial lines or rays, similar to rays 46A-46F of FIG. 3 extend from the geometric center of the second table 176 to the outer edge 188.

Scaled indicia 193 such as white colored consecutive point marker designations "10", "20", "30", "40" and "50", are disposed within associated play segments 195. Game themed indicia such as shamrocks 192 are disposed within play segments 195 constituting inner cup positioning markers. Game themed indicia such as stylized leprechaun hats 194 are disposed within neutral play segments 196. A single large shamrock 198 covers the playing surface 182 of the second table 176.

A vertically upstanding net assembly 200 bifurcates the playing surfaces 180 and 182 of the first and second tables 172 and 176, respectively, extending radially through neutral play segments 196 along an axis designated A-A. The net assembly 200 extends well above the upper lip of the largest cup employed in any intended game, effectively forming a barrier preventing a ping pong ball in play by one team from entering the opposing team' playing area.

Although the net assembly 200 could consist of a single, continuous net extending the entire diameter of the lower table 172, it preferably consists of three distinct segments, left and right outer segments 202 and 204, respectively, and center segment 206. Each net segment 202, 204 and 206 consists of an opposed pair of vertical support stanchions 208 interconnecting a net portion 210 in tension. Each stanchion 208 is slip fit within a blind bore 212 formed in the playing surfaces 180 and 182 of the bottom and upper tables 172 and 176, respectively. So constructed, one or more of the net segments 200, 202 and 204 can be removed to change the nature of the game.

Additional decorative shamrocks 214 and pinstripes 216 can be added as desired to the table edges 184 and 186, the elongated support member 178, the legs 173 and the cross members 175 for ornamental appeal.

The enlarged shamrock 198 is centered on the playing surface 182 of the top table 176 and is bifurcated by the center net segment 206. The shamrock 198 is enlarged to form a double circular hub comparable to the circular hub 44 of the playing surface 40 of the top table 42 of FIGS. 1 and 3. The net assembly 200 requires the use of two cups within the shamrock 198, one on each side of the center segment 206 of the net assembly 200, one for each of the opposing teams.

Referring to FIGS. 13-25, additional game variants are described which differ from the game variants of FIGS. 1-12 in certain respects. By way of non-limiting example, the game variants of FIGS. 13-25 include reconfigurability, in which an electronic semi-rigid barrier or target screen is provided which replaces the net assembly 200 with an interactive target which can be secured on a game table such as depicted in FIGS. 11 and 12 to bisect the playing surface for simultaneous play by two or more opposed player teams. Alternatively, the target screen can be mounted to a vertical wall surface and the table eliminated, wherein all players (on both teams) are positioned on the same side of the target screen for alternating play of such games as darts, racket ball and the like. Furthermore, the present invention enables simultaneous use of targets such as cups 56 and targets such as those appearing on the electronic barrier/target screen in a single game to continuously convey game status information to players on one or both sides of the barrier target screen.

Figure 13:
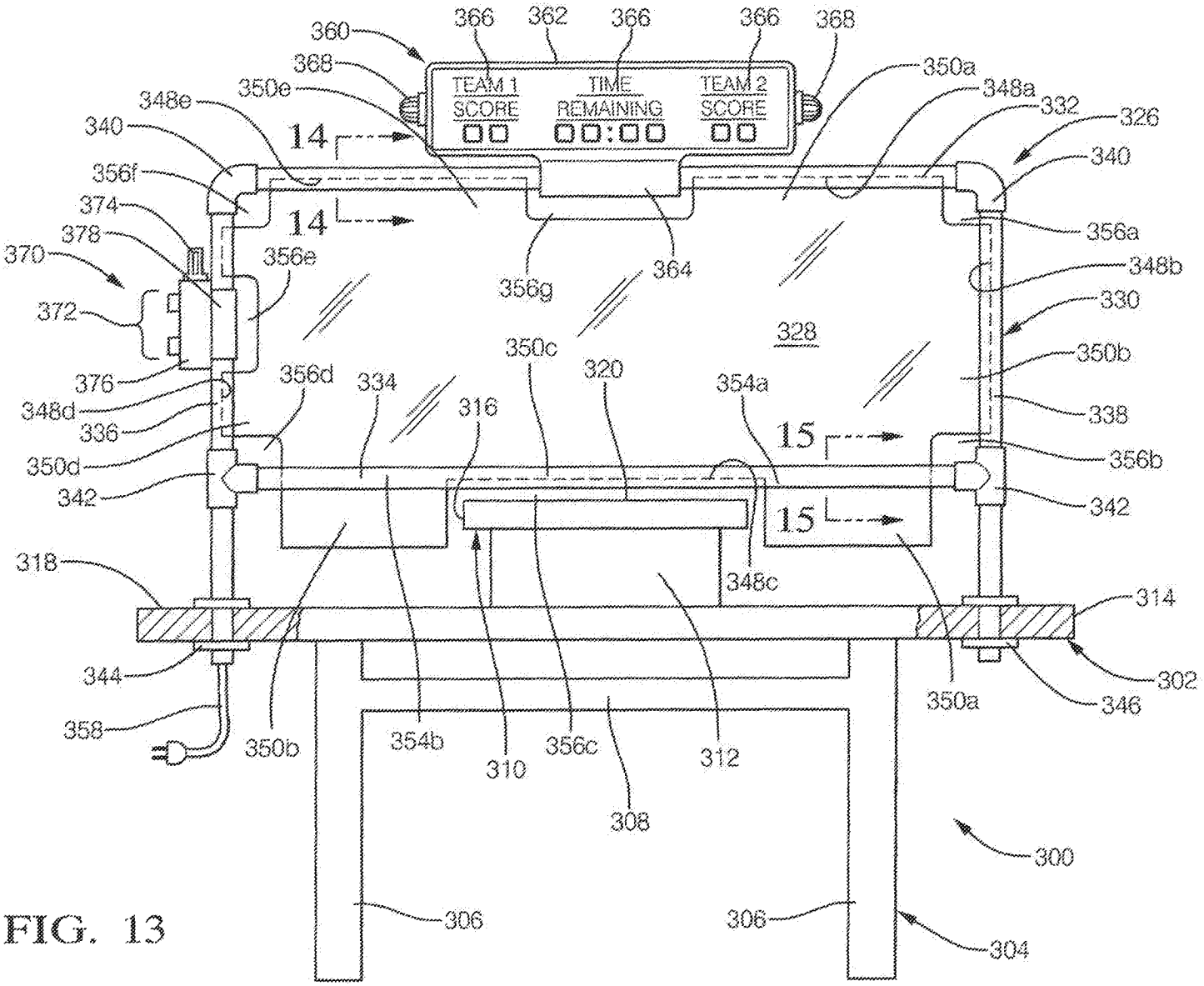
FIG. 13, is a side plan, broken view of a second alternative embodiment of the present invention, and structured similarly to that depicted in FIGS. 11-12, but with more rigid construction appropriate for semi permanent or indoor use and for selective reconfiguration to facilitate floor and wall mounted configurations, wherein the net system of FIGS. 11 and 12 is replaced by a semi-rigid clear planer barrier electrically interactive screen supported by a tubular peripheral frame mounted on the lower table which includes an electrical controller and a mono/bidirectional display system.

Referring to FIG. 13, a two level table assembly 300, is similar in many respects to game table assembly 170 of FIGS. 11 and 12, and includes a first or bottom table 302 supported on a rigid fixed leg assembly 304 affixed to the lower surface (not illustrated) thereof. The leg assembly 304 includes a plurality (such as 4) circumferentially spaced logs 306 and a plurality (such as 4) of cross members 308 interconnecting adjacent leg pairs 306. A second or top table 310 is arranged concentrically above the bottom table 302 and is retained in a fixed position by a vertically elongated support member 312. The tables 302 and 310 can be fabricated from composite material such as plywood which is subsequently painted, but preferably are injection or blow molded from plastic with the artwork integrated therein.

Tables 302 and 310 are round and form circumferentially continuous outwardly facing edges 314 and 316, respectively. Playing surfaces 318 and 320 are formed on the bottom table 302 and the top table 310, respectively, which can be decorated and colored in suitable motif. The design can be altered depending upon the theme, activity or the like. Tables 302 and 310 are preferably round, but can be elliptical or elongated to enhance playing surface for a given application/game.

In FIG. 13, the net assembly 200 of FIG. 12 is replaced by a vertically extending barrier structure 326 mounted to the bottom table 302, which substantially bisects the lower and upper playing surfaces 318 and 320, respectively. The barrier structure 326 consists of a rigid, semi-transparent electrically interactive screen 328, such as plexiglass which is supported about its periphery by a tubular frame 330. The frame 330 includes upper and lower horizontally elongated tubular members 332 and 334, respectively, which are joined with left and right vertically elongated tubular member 336 and 338, respectively. The ends of the tubular members 332, 334, 336 and 338 are joined in a frame structure 330 by appropriate right angle or "L" and "T" shaped joint members, 340 and 242, respectively. The left and right members 336 and 338 extend below the lower horizontal tubular member 334, and terminate in flanged removable fitting 344 and 346. The entire frame structure 330 is preferably formed of PVC pipe or its equivalent which are glued or otherwise interconnected in assembly.

Figure 14:
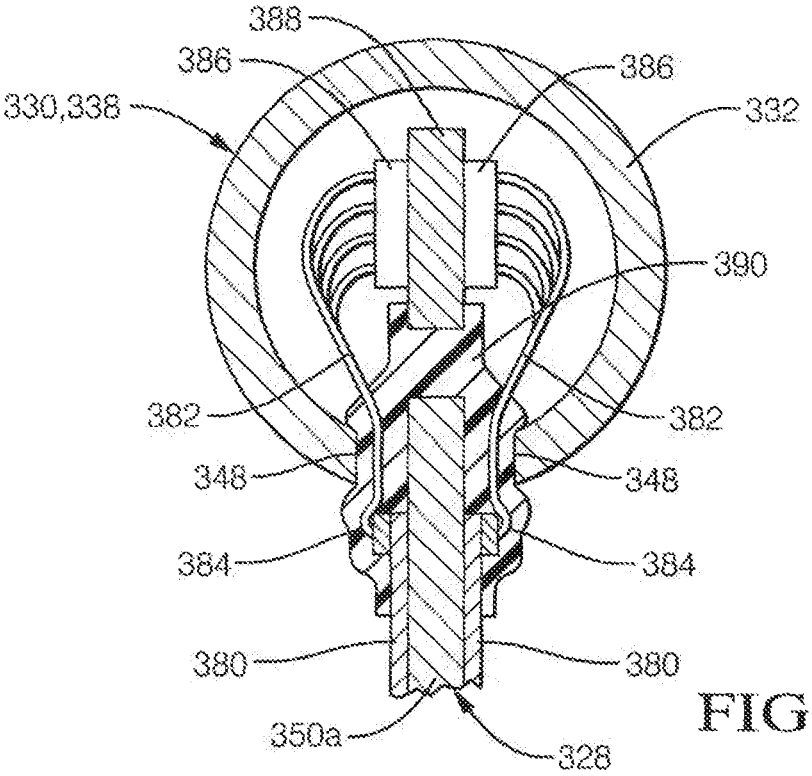
FIG. 14, is a cross section of an upper member of the tubular peripheral frame of FIG. 13, illustrating the interface of the electrical controller with the clear planer barrier screen wherein it extends partially through and is affixed to the upper frame member.

All of the elements of frame structure 330 are hollow, enabling dressing structural components, such as batteries and electrically conductive wires, there through. Each of the tube members 332, 334, 336 and 338 have keyed slots 348*a-d* formed in the inwardly facing surfaces thereof for receiving mating extensions 350*a-d* distributed about the outer perimeter of the electrically interactive screen 328 as best seen in FIGS. 13 and 14. Extensions 352*a* and 352*b* are extended to pass entirely through respective through slots 354*a* and 354*b*, best seen in FIGS. 13-15. Corners and defined edge locations of the semi-transparent screen 328 have recesses 356*a-f* formed therein to provide clearance from adjacent joint members 340 and 342 and other attachment points. Extensions 350*a* and 350*b* extend entirely through associated slots 354*a* and 354*b*, respectively, and further extend downwardly toward the lower table play surface 318 to block object balls or other thrown gaming implements from passing beyond the barrier established by the semi transparent screen 328.

A suitable electrical cable 358 emerges from the open lower end of left tubular member 336 for routing clear of the game space and facilitating interconnection to a host a.c. power grid or stored energy source.

A display assembly 360 including a housing 362 is affixed to the upper tube member 332 by a clamp assembly 364 to position unidirectional or bidirectional readouts 366 for viewing by game players and nearby onlookers. Large signal lights 368 are carried on the housing 362 to alert the players, onlookers and establishment management to a significant gaming event. Electrical wiring (not illustrated) from the display assembly 360 is routed within the upper tube member 332 for interconnection with the remainder of the electrical system.

A local control device 370 including a key pad 372 and a vending mechanism 374 communicates with establishment management. The local control device 370 has a housing 376 affixed to the left tubular member 336 by a clamp 378. Electrical wiring (not illustrated) from the control device assembly 360 is routed within the left tubular member 336 for interconnection with the remainder of the electrical system, including devices such as telephones, etc.

Referring to FIG. 14, a sectional view of the upper tube member 332 illustrates the composition of the interactive semi-transparent screen 328 and its electrical interconnection with control circuits largely contained within the tubular frame 338. The electrically interactive screen 328 consists of a rigid planer sheet of plexiglass or other suitable material with semi transparent liquid crystal displays (LCD) 380 affixed on the outer surfaces of the rigid screen 328. Alternatively, a plastic film or screen such as produced by Royole can be laminated over a rigid thin material (not illustrated). Typically, such material must be non-transparent or else images could show mirrored on the other side of the screen 328. There must be some form of non-transparent barrier to which the laminate screen is adhered. Typically, the displays 380, by way of example, LCDs, extend near the outer edge of the screen 328 to facilitate its electrical interconnection with a wiring harness 382 and control circuits. The LCDs 380 include contacts 384 electrically interconnected with the wiring harness 382 which, in turn, transitions into electrical connectors 386 interfacing with a printed circuit board 388. The edge of the LCDs 380, the contacts 384 and the adjacent conductor ends of the wiring harness 382 are insert molded within a resilient insulating plug 390 of rubber or other suitable material effecting hermetic sealing and resilient engagement with the adjacent slot 348 of the tubular frame 338/330. Alternatively, a thin film sensor can be employed under, for example a urethane molded component (not illustrated) to act as an impact or touch sensor.

Figure 15:
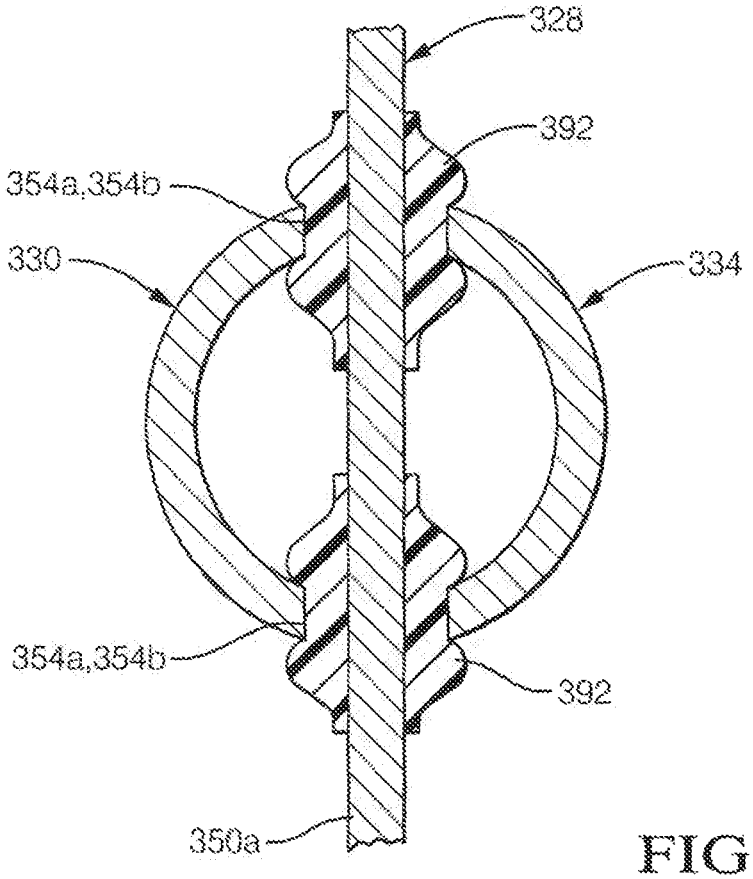
FIG. 15, is a cross section of a lower member of the tubular peripheral frame of FIG. 13 illustrating its interconnection with the clear planer barrier screen wherein it extends entirely through and is affixed to the lower frame member.

Referring to FIG. 15, the extensions 350*a* of the electrically interactive screen 328 extend entirely through the through slots 354*a* and 354*b* formed in the lower tube member 334 of the tubular frame 330. The slots 354*a* and 354*b* are dimensioned for a loose interfit with the partially transparent screen 328. Resilient plugs 392 are compressively wedged between the screen 328 and the adjacent slots 354*a* and 354*b* to isolate and prevent motion there-between.

Figure 16:
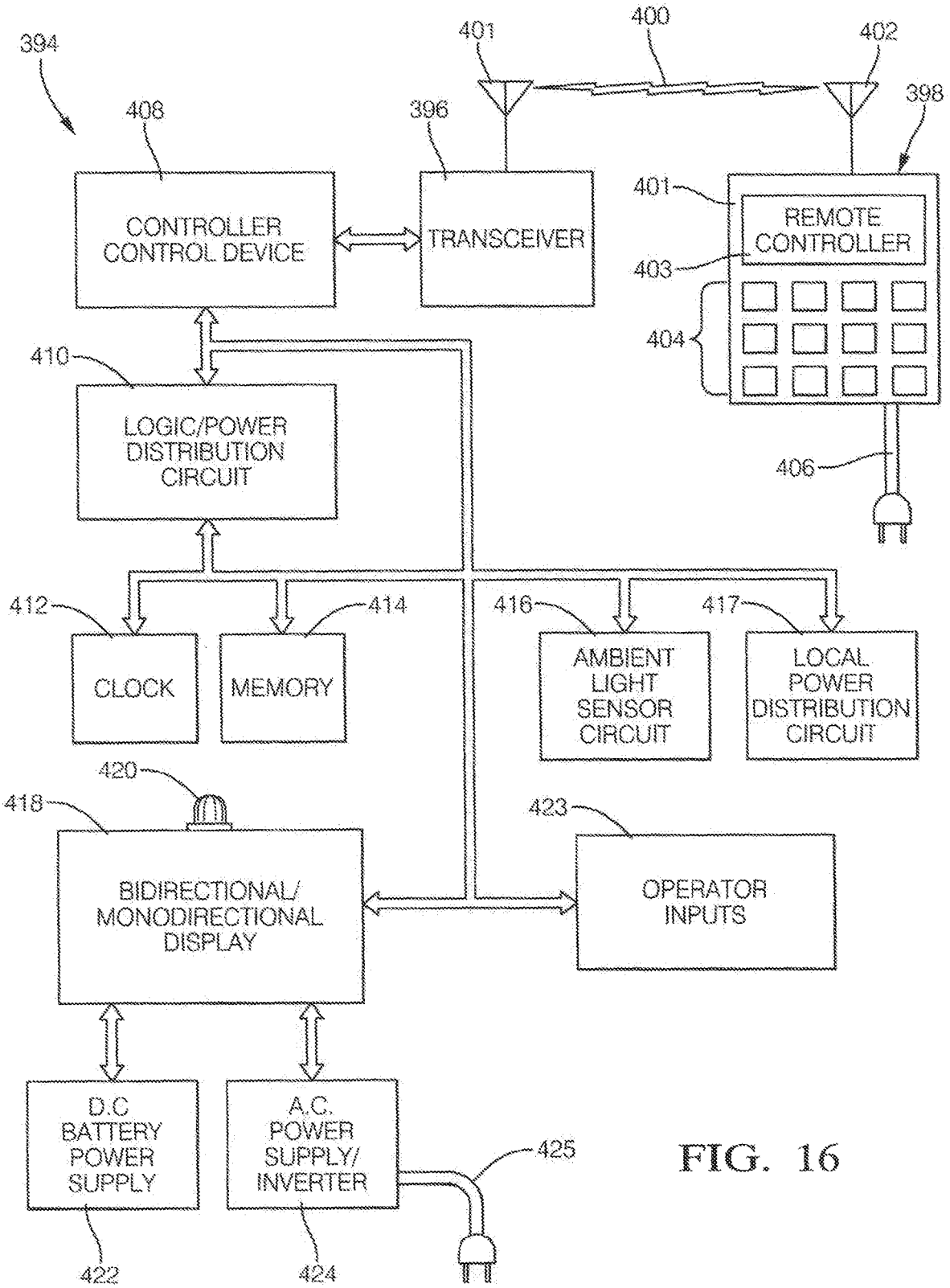
FIG. 16, is an electrical schematic of the embodiment of FIGS. 13-15 and its interface with a remote master controller.

Referring to FIG. 16, an electric circuit 394 for operating the speed-pong game includes a transceiver 396 operative to receive signals from and transmit signals to a remote controller 398 via a wireless link 400. The remote controller 398 is intended to be located closely to a host manager for receiving inputs regarding system operation and exercising direct control of its operation.

The remote controller 398 includes a compact housing assembly 402, a transmitting/receiving antenna 402 and a connector 406 interfacing with an alternate power source such as a battery or other energy source device.

The transceiver 396 has an antenna 401 which receives and sends signals to the remainder of the electric circuit 394, specifically to a controller or control device 408. The controller 408 interfaces with a logic/power distribution circuit 410, which, in turn, interfaces with a clock circuit 412, volatile and non-volatile memory circuits memory circuits 414, an ambient light sensor circuit 416 and a local power distribution circuit 418.

The controller 408 also interfaces with the bidirectional-mono-directional display circuit 418 which includes a visual or audible status announcer circuit 420, which, in turn, is interconnected with a display power system including a d.c. current power supply 422 and an a.c. power supply or inverter 424 having a local power supply connection 425. Lastly, the controller 408 interfaces with local/player operator inputs 423.

Figure 17:
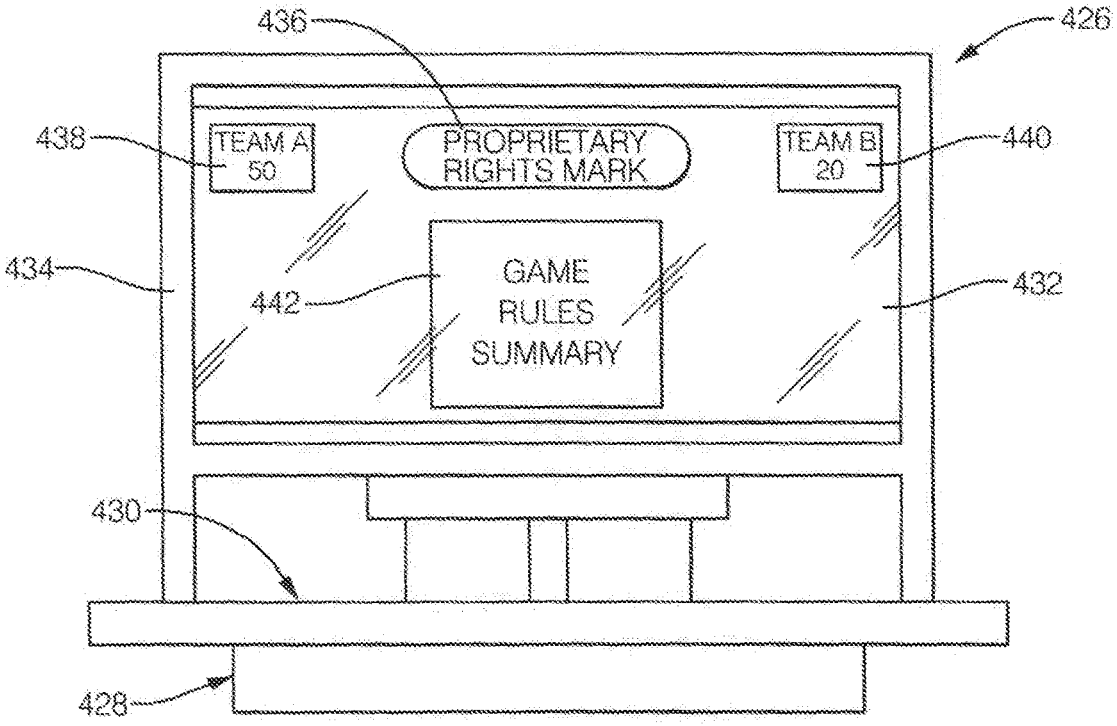
FIG. 17, is an interactive digital barrier display which presents current game score and game rules (of a host enterprise) wherein the barrier screens comprise touchscreens providing touch sensitive play, and wherein, the touch barrier screens are powered by electrical conductors extending through a tubular frame as depicted in FIG. 14 whereby rechargeable/removable batteries, an ac/dc converter, a standard power source, and a small computer/controller is fixed to the bottom of the associated table.

FIG. 17 is a simplified depiction of a speed-pong game assembly 426 similar to that of FIG. 13, including a base assembly 428 supporting a two level table assembly 430 and a bidirectional touch screen display panel 432 circumscribed by a hollow frame 434. In the illustrated operational mode, the display panel 432 projects certain information in four distinct fields, including a proprietary legend 436, the name and current score status of a first team (Team A—50 points) 438, the name and current score status of a second team (Team B—25 points) 440, and a rule summary of the selected game 442. The display panel 432 is in "touch-screen" mode and is touch sensitive for recording score points. The screens are powered by wiring within the hollow frame and extending to the base assembly 428. There is a rechargeable/removable battery and a small computer/controller (not illustrated) fixed to the bottom of the table 430. The screen 432 is illuminated on front and rear sides of the display panel 432, and can be laminated as illustrated in FIG. 14.

Figure 18:
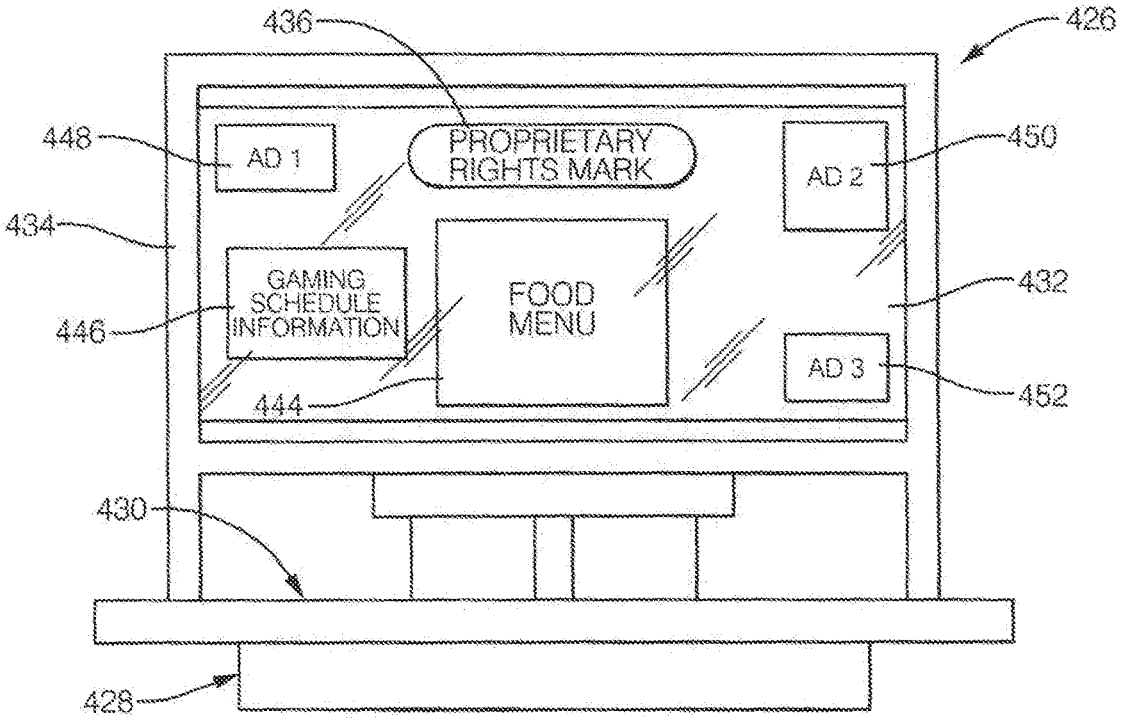
FIG. 18, is the interactive digital barrier display of FIG. 17 which presents game rules, promotional notices, menu and advertisements (of a host enterprise)

FIG. 18 is a simplified depiction of a speed-pong game assembly 426 similar to that of FIG. 17, including a base assembly 428 supporting a two level table assembly 430 and a bidirectional touch screen display panel 432 circumscribed by a hollow frame 434. In the illustrated attraction mode, the display panel 432 projects certain information in six distinct fields, including a proprietary legend 436, a food menu 444 currently offered by the host, gaming schedule information and availability 446, and three separate targeted promotional advertisements 448, 450 and 452 for, by way of example, a local restaurant, specific beverages for sale, and current drink specials. The display panel 432 is in "touchscreen" mode and is touch sensitive for ordering or soliciting additional information from management. The screens are powered by wiring within the hollow frame and extending to the base assembly 428. There is a rechargeable/removable battery and a small computer/controller (not illustrated) fixed to the bottom of the a\table 430. The screen 432 is illuminated on front and rear sides of the display panel 432, and can be laminated as illustrated in FIG. 14.

Figure 19:
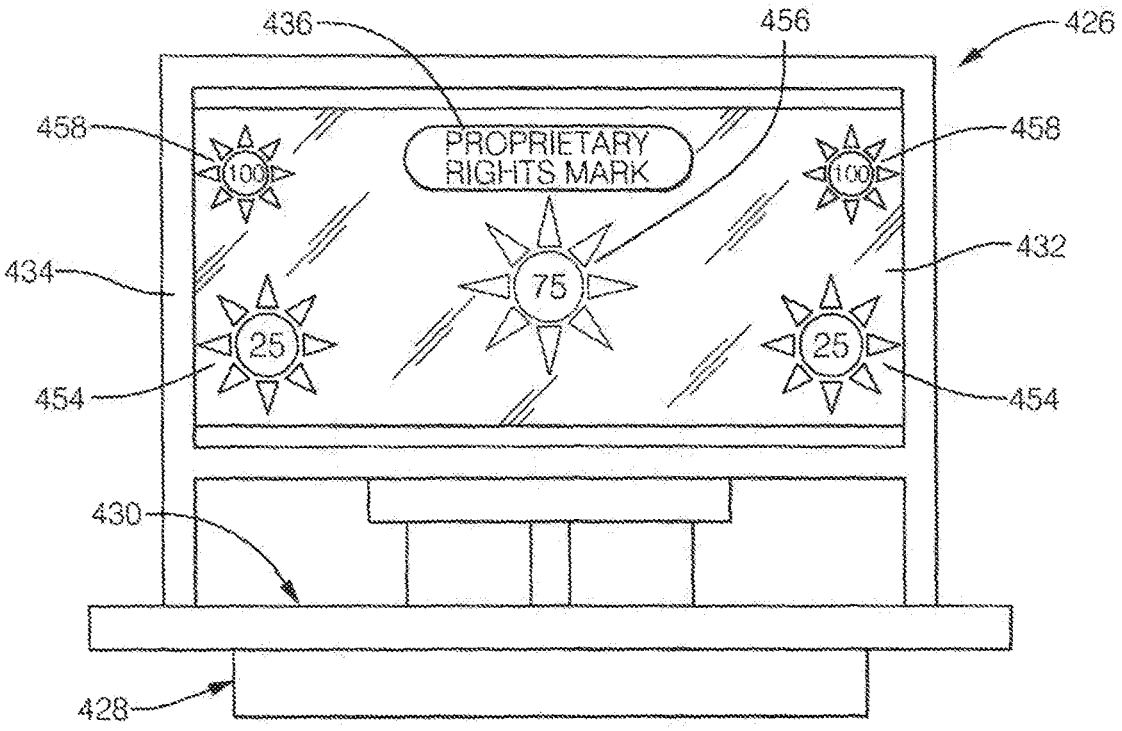
FIG. 19, is an interactive digital barrier display which incorporates a plurality of fixed targets of varying size and scoring weight for a given game, wherein the barrier screens comprise touchscreens wherein play is touch sensitive to a specially coated Ping Pong ball or other objects hitting the digital barrier display screen, and the game object is to hit the target.

FIG. 19, is a simplified depiction of a speed-pong game assembly 426 similar to that of FIG. 17, including a base assembly 428 supporting a two level table assembly 430 and a bidirectional touch screen display panel 432 circumscribed by a hollow frame 434. In the illustrated game play mode, the display panel 432 projects certain information in a single distinct fixed field, including a proprietary legend 436, five (5) distinct targets are projected on the field of play. Iwo low value targets 454 (25 points), one intermediate value target 456 (75 points), and two high value targets 458 (100 points) are projected on the display panel 432. The display panel 432 is in "touchscreen" mode and is touch sensitive for continuing animated play by the teams. The screens 432 are powered by wiring within the hollow frame and extending to the base assembly 428. There is a rechargeable/removable battery and a small computer/controller (not illustrated) fixed to the bottom of the a\table 430. The screens 432 are illuminated on front and rear sides of the display panel 432, and can be laminated as illustrated in FIG. 14. The targets 454, 456 and 458 can be fixed in size and location. However, they can periodically relocate on the screen 432 and/or "grow" to change in play value. Furthermore, the targets can gradually or instantaneously relocate and, when moving, unexpectedly alter their trajectory.

Figure 20:
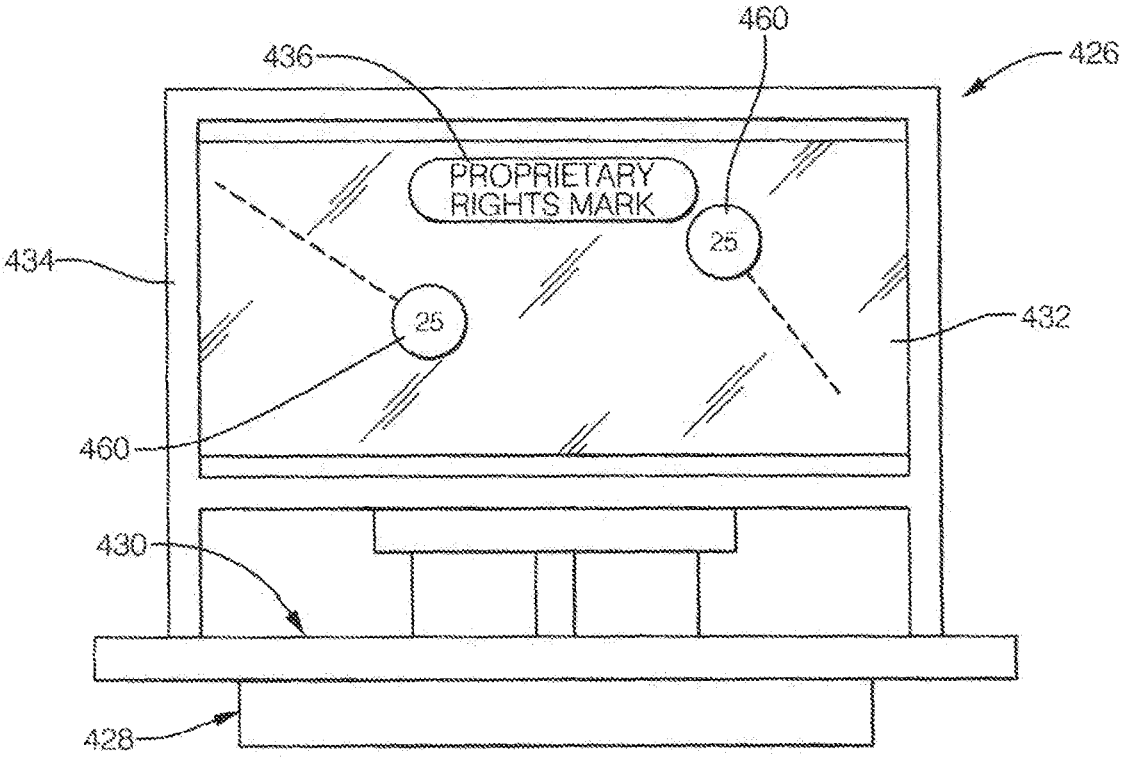
FIG. 20, is an interactive digital barrier display which incorporates a single or plurality of moving targets for a given game, wherein the barrier screens are comprise touchscreens wherein play is touch sensitive to a specially coated Ping Pong ball or other objects hitting the digital barrier display screen, and the game object is to hit a moving target.

Referring to FIG. 20, is a simplified depiction of a speed-gong game assembly 426 similar to that of FIG. 17, including a base assembly 428 supporting a two level table assembly 430 and a bidirectional touch screen display panel 432 circumscribed by a hollow frame 434. In the illustrated game play mode, the display panel 432 projects certain information in a single distinct fixed field, including a proprietary legend 436 projected on the field of play. Furthermore, two targets 460 (25 points/each) move along a fixed or varying path to present a more difficult targeting game. The size, speed and/or value of the targets 460 can be varied during the game. The display panel 432 is in "touch-screen" mode and is touch sensitive for continuing animated play by the teams. The screens 432 are powered by wiring within the hollow frame and extending to the base assembly 428. There is a rechargeable/removable battery and a small computer/controller (not illustrated) fixed to the bottom of the table 430. The screens 432 are illuminated on front and rear sides of the display panel 432, and can be laminated as illustrated in FIG. 14.

Figure 21:
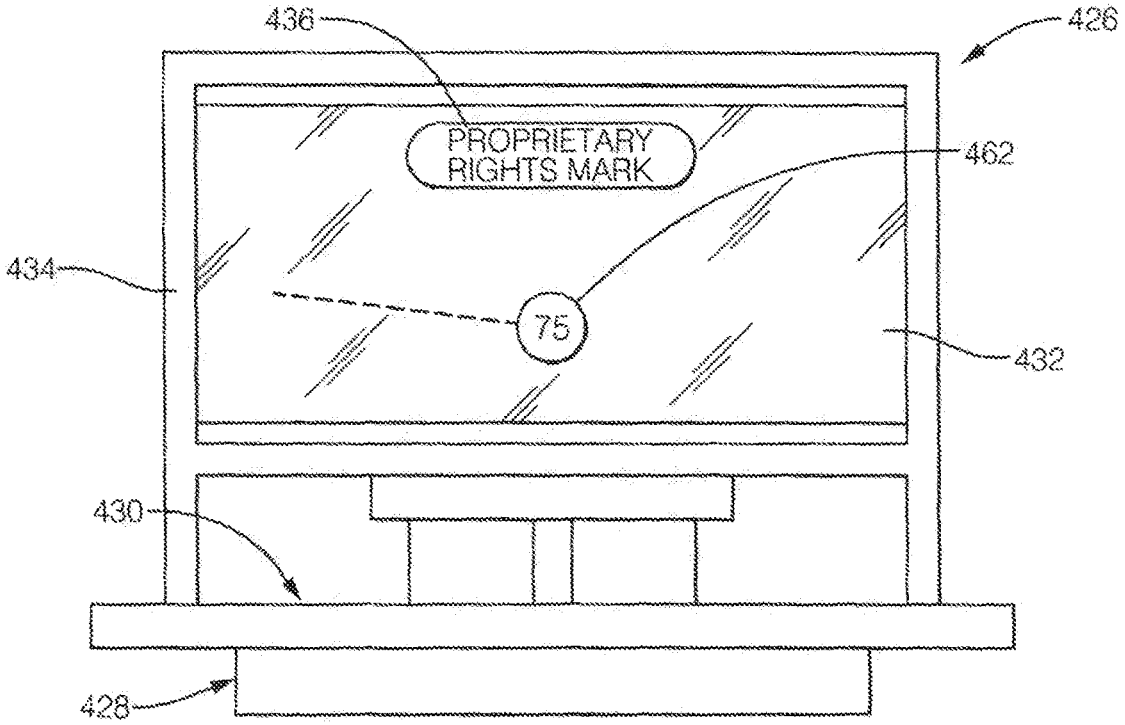
FIG. 21, is an interactive digital barrier display similar to FIG. 20 wherein a more difficult (smaller and or faster moving) target with a higher point count is presented to the player(s)

Referring to FIG. 21, is a simplified depiction of a speed-pong game assembly 426 similar to that of FIG. 17, including a base assembly 428 supporting a two level table assembly 430 and a bidirectional touch screen display panel 432 circumscribed by a hollow frame 434. In the illustrated game play mode, the display panel 432 projects one or more targets (tracking balls) 462 which is smaller, faster and of higher point value than the game configuration of FIG. 20. The display panel 432 is in "touchscreen" mode and is touch sensitive for continuing animated play by the teams. The screens 432 are powered by wiring within the hollow frame and extending to the base assembly 428. There is a rechargeable/removable battery and a small computer/controller (not illustrated) fixed to the bottom of the table 430. The screens 432 are illuminated on front and rear sides of the display panel 432, and can be laminated as illustrated in FIG. 14.

Figure 22:
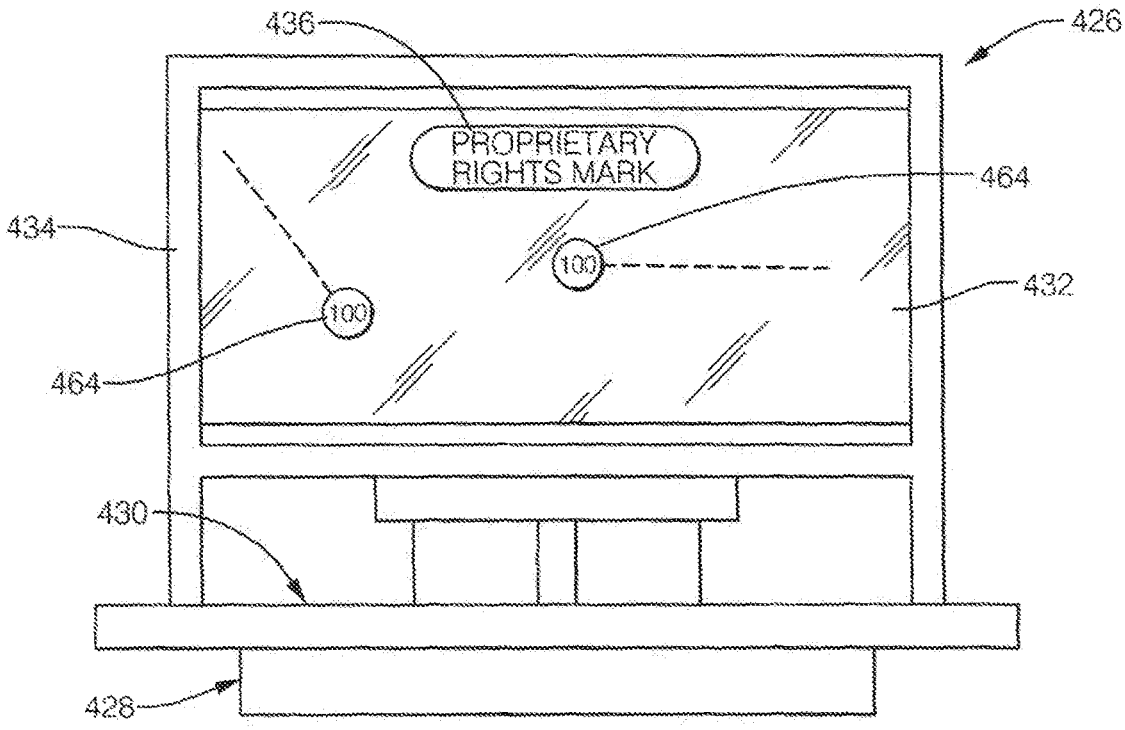
FIG. 22, is an interactive digital barrier display similar to FIG. 21 wherein a still more difficult target (multiple, smaller, faster moving and/or higher point count) is/are presented.

Referring to FIG. 22, is a simplified depiction of a speed-pong game assembly 426 similar to that of FIG. 17, including a base assembly 428 supporting a two level table assembly 430 and a bidirectional touch screen display panel 432 circumscribed by a hollow frame 434. In the illustrated game play mode, the display panel 432 projects one or more targets (tracking balls) 464 which is smaller, faster and of higher point value than the game configuration of FIG. 20. The game variant of FIG. 22 is a variant or continuation of the game of FIG. 21 wherein multiple, smaller, higher traverse speed and higher point targets 464 are presented in the game. The display panel 432 is in "touchscreen" mode and is touch sensitive for continuing animated play by the teams. The screens 432 are powered by wiring within the hollow frame and extending to the base assembly 428. There is a rechargeable/removable battery and a small computer/controller (not illustrated) fixed to the bottom of the table 430. The screens 432 are illuminated on front and rear sides of the display panel 432, and can be laminated as illustrated in FIG. 14.

Figure 23:
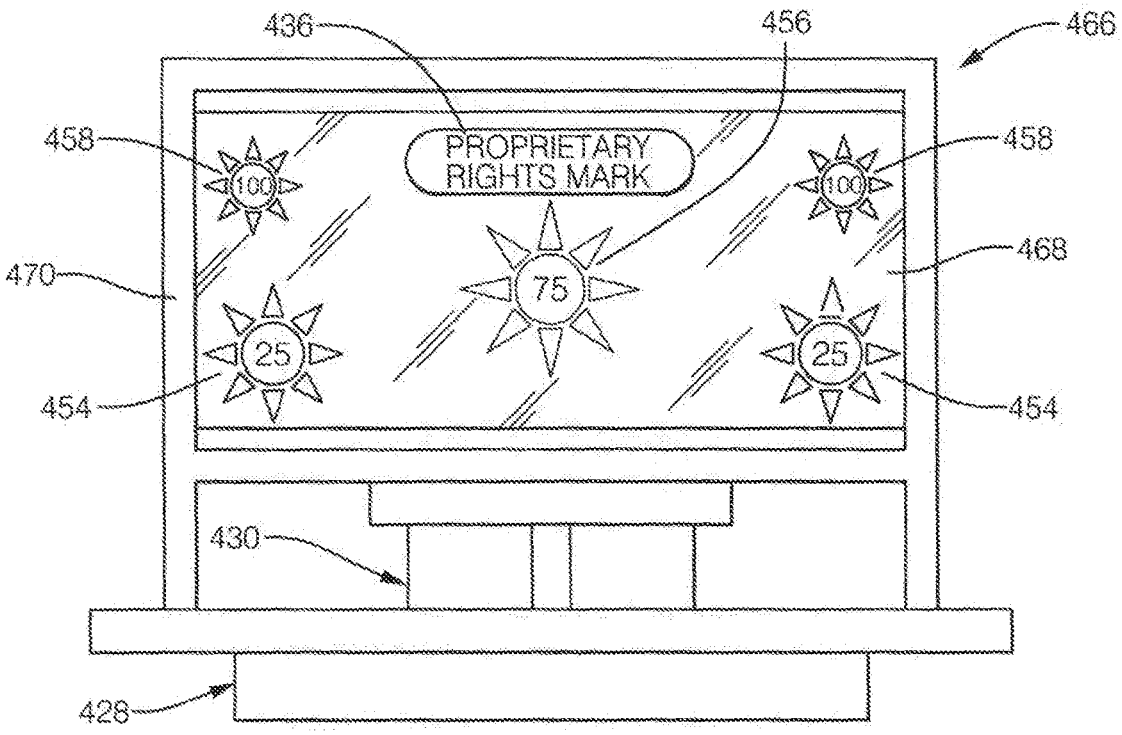
FIGS. 23 and 24, depict an interactive digital barrier display with targets having the same size, position and weighting, similar to that of FIG. 19, but where the display can be removed from its host floor table or hung on a vertical supporting surface (wall) as a stand-alone game such as darts with a specially coated Ping Pong ball or other similar coated object.
Figure 24:
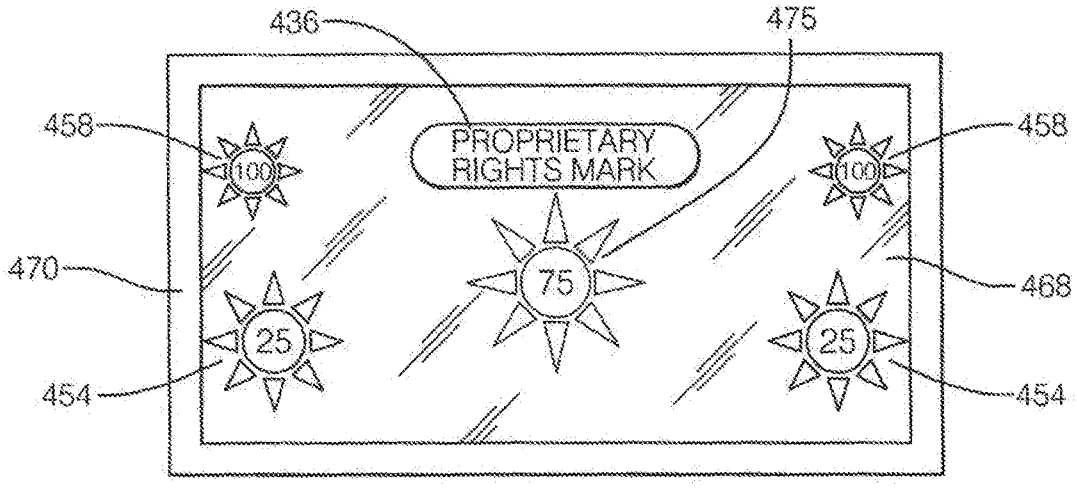

Referring to FIGS. 23 and 24, wherein FIG. 23 is identical to FIG. 19, with the exception that the speed-pong game assembly allows removal of the display panel 468 and frame 470 from the base assembly 428 and two level table assembly 430. Furthermore, all necessary electrical circuit components remain with the display panel 468 and frame 470, enabling its full utilization apart from the base assembly 428 and two level table assembly 430.

Figure 25:
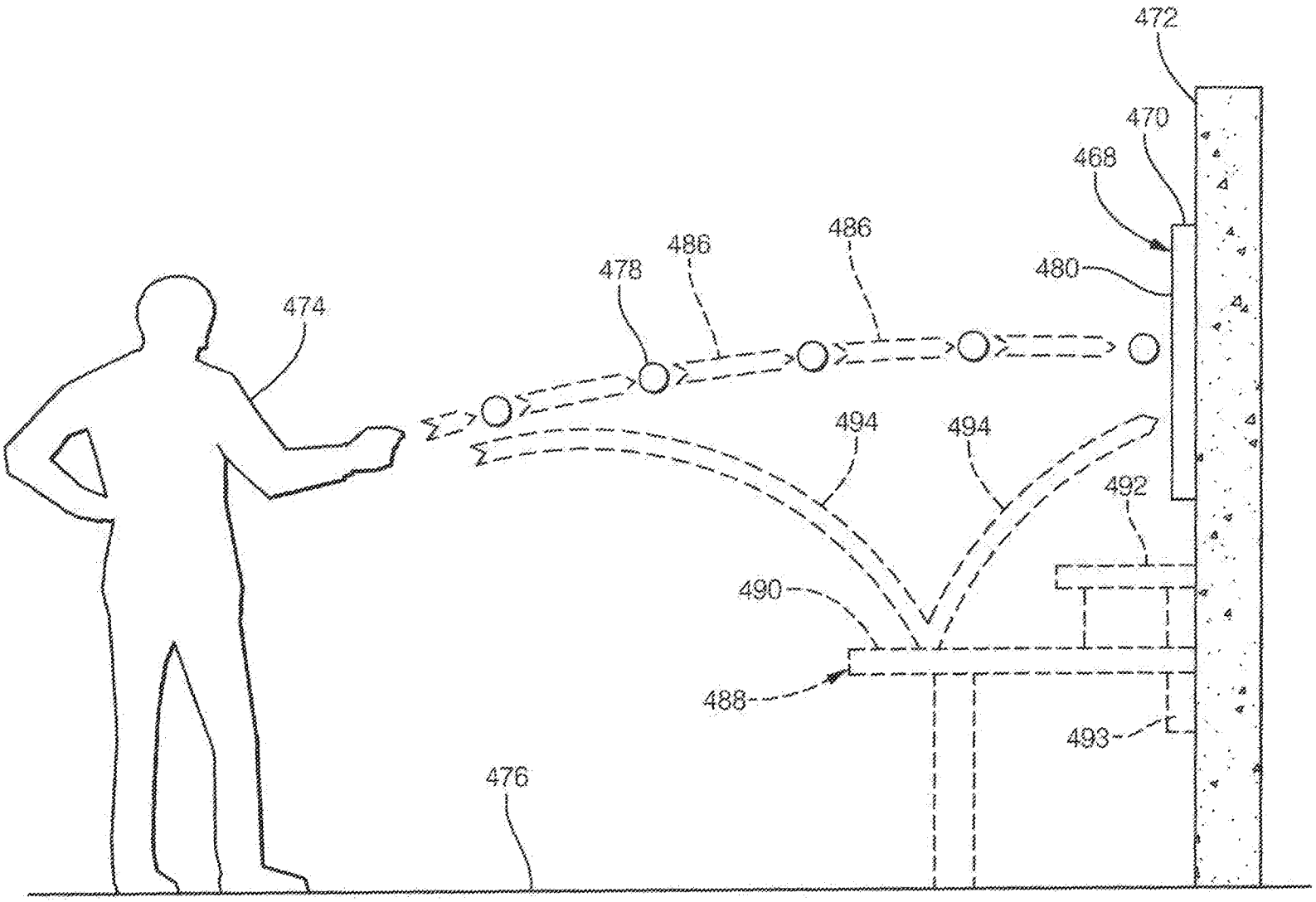
FIG. 25, presents a side view of the interactive digital barrier display game configuration of FIG. 24 depicting a player distanced from the wall mounted interactive target digital barrier display propelling a specially coated Ping Pong ball or other objects along an arc toward the interactive target digital barrier display.

Referring to FIG. 25, a side view depiction of a game in process includes the display panel 468 and frame 470 vertically mounted on a wall 472 or other suitable mounting support structure. The display panel 468 is preferably positioned at approximately eye level of a player 474 standing on a horizontal surface 476 such as a floor and an object ball 478 is thrown directly against the exposed target surface 480 of the display panel 468 along a trajectory depicted by arrows 486. Alternatively, a half-table 488 (shown in phantom) can be placed against the wall 472 directly under the display panel 468. With this arrangement, object balls 478 can be bounced or ricocheted off exposed upper surfaces of lower and upper table surfaces 490 and 492, respectively, of the half-table 488 and against the exposed target surface 480 of the display panel 468 as illustrated by arrows (shown in phantom) 494.

During the games presented herein above, the opposing teams can choose to alternate play. Alternately, they can play simultaneously as a race or contest of speed. Further, the game can be adjusted to alter the speed, direction or value of moving targets in response to a "hit" by the opposing team. Furthermore, more than two teams can simultaneously participate by altering turns on a given side of the screen 432. In that way, three, four or more teams can play in a common game. When activated, the screen 432 is "touch sensitive to a Ping Pong ball or other objects touching or hitting the screen 432. The Ping Pong ball may require a special coating.

The following documents are deemed to provide a fuller background disclosure of the inventions described herein and the manner of making and using same. Accordingly, each the below-listed documents are hereby incorporated into the specification hereof by reference.

Wikipedia Rules regarding "Beer Pong" date unknown.
Wikipedia Rules regarding "Flip Cup" date unknown.
U.S. Pat. No. 3,372,934 to Heil entitled "Game Board and Small Bounceable Ball".
U.S. Pat. No. 5,007,650 to Reed et al entitled "Method of Playing a Board Game of College Social Life".
U.S. Pat. No. 6,276,686 B1 to Chille entitled "Board Game and Method for Teaching Responsible Drinking".
U.S. Patent Application Publication No. 20040188942 A1 to Trokan entitled "Non-Alcoholic Beer-Pong System".
U.S. Patent Application Publication No. 2005/0029747 A1 to Grayson entitled "Drinking Game Cup Holder".
U.S. Patent Application Publication No. 2005/0116413 A1 to Wagner entitled "Board Game incorporating Drinking Beverages and Method of Playing Board Game, and Board and Gamepieces Thereof and Method of Use Thereof".
U.S. Patent Application Publication No. 2006/0226606 A1 to Finley et al. entitled "Portable Game Device and Method of Use".
U.S. Patent Application Publication No. 2007/0200293 A1 to Gomez et al. entitled "Board Game and Method with Social Drinking Theme".
U.S. Pat. No. 7,325,807 B1 to Eason entitled "Beer Pong Table".
U.S. Pat. No. 7,516,960 B1 to Battiste entitled "Inflatable Table".
U.S. Pat. No. 7,805,959 B2 to Webb el al. entitled "Cup Holder for Drinking Game".
U.S. Patent Application Publication No. 2014/0015197 A1 to Maffei el al. entitled "Beer Pong Game and Method of Playing".
U.S. Pat. No. 8,905,406 B2 to Brown entitled "Portable Point/Beer Pong Table".
U.S. Design Pat. No. D755,898 S to Blanchard entitled "Cap for Beer Pong Game".
U.S. Patent Application Publication Number 2011/0096263 A1 to Medendorp, J R. et al. entitled "LED Backlight System for LCD Displays".

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, the circular hub lines defining part of the generally trapezoidally shaped play segments can be imaginary, meaning that they can be a designated circular location, but not necessarily imprinted or formed on the playing surface. Furthermore, temporary covers for the upper and lower table portions can be provided for post-game food service. The upper table portion can be converted into a "lacy Susan" condiment server. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. A compact, multi-level speed-pong table game assembly for use in a game including at least one ping gong type game ball and a plurality of ball receiving open topped beverage cups, each cup having a nominal height h and a maximum lip diameter d1, wherein said table game assembly comprises:

a first table forming a substantially circular upwardly facing flat/smooth horizontal playing surface and a circumferentially continuous outwardly facing edge having a nominal diameter of dimension D1;

a second table forming a second substantially circular upwardly facing flat/smooth horizontal playing surface, a bottom surface and a circumferentially continuous outwardly facing edge having a nominal diameter of dimension D2, wherein dimension D1 is greater than the sum of dimension D2 plus two times the cup maximum lip diameter d1;

a vertical support member concentrically rigidly interconnecting the first table playing surface with the second table bottom surface, said support member having a maximum lateral dimension equaling D2 and vertically interspacing the first and second table playing surfaces by a dimension approximately equaling nominal beverage cup height h;

a plurality of cup positioning markers formed on said first and second table playing surfaces for locating said beverage cups thereon, said cup positioning markers located on said first table playing surface being disposed radially intermediate said first table outwardly facing edge and said second table outwardly facing edge;

an elongated barrier assembly extending vertically above said first and second playing surfaces and horizontally bisecting said first upwardly facing playing surface and said second upwardly facing playing surface, said vertical barrier operative to define discrete opposed team play areas enabling a plurality of teams to play simultaneously on opposed sides of said barrier and to prevent horizontal travel of game balls between opposing team play areas, said barrier supported by at least one vertically elongated support stanchion dimensioned for removable slip-fit within an associated bore formed within at least on of said playing surfaces to enable selective removal and insertion thereof, said barrier assembly comprising a substantially rigid semi-transparent screen having a touch-sensitive reconfigurable electronic display formed on at least one surface thereof; and an electrical controller operative to detect the impact of a game ball against said at least one surface and to generate an optically sensible message on said screen surface in response thereto.

2. The table game assembly of claim 1, wherein said barrier comprises touch-sensitive reconfigurable electronic displays formed on both surfaces thereof.

3. The table game assembly of claim 1, wherein said barrier comprises a generally tubular circumferential frame circumscribing said screen and operative to house electrical components and route electrical conductors in circuit with said electronic displays.

4. The table game assembly of claim 3, wherein said barrier comprises a local control device affixed to said frame to facilitate player inputs to the game assembly.

5. The table game assembly of claim 1, wherein portions of said barrier extends below said second playing surface to effect blocking of game balls from traveling between said opposed team play areas.

6. The table game assembly of claim 1, wherein said barrier assembly comprises a vertical elongated support stanchion dimensioned for removable slip-fit within an associated bore formed within said playing surface to enable selective removal and insertion thereof.

7. The table game assembly of claim 1, further comprising a hanger affixed to said barrier assembly operable to effect mounting thereof on a remote vertical surface while maintaining functionality of said game assembly.

8. The table game assembly of claim 1, further comprising a remote electrical controller operative to effect programming and operational control thereof.

9. The table game assembly of claim 1, wherein said controller includes a clock circuit operative to simultaneously monitor the total elapsed play time and rate of play of two competing teams.

10. The table game assembly of claim 1, wherein said controller includes logic means operative to selectively vary target numbers, size and point weight, trajectory and traversal speed independent of player inputs.

11. The table game assembly of claim 1, wherein said controller includes logic means operative to selectively interrupt active game play scoring and to momentarily substitute informational and promotional notices on the barrier assembly screen.

12. The table game assembly of claim 1, further comprising:

at least one leveling device supported by said table operable to affect two axis leveling; and a plurality of elongated legs removably affixed to the lower surface of said first table.

13. The table game assembly of claim 12, wherein said plurality of elongated legs are each individually adjustable in length.

14. The table game assembly of claim 13, wherein at least one of said plurality of elongated legs forms a lower end terminating in a ground engaging extension serving to fixedly anchor the table game assembly to the underlying ground surface.

15. The table game assembly of claim 1, wherein said support member is operable to selectively incrementally or infinitely vary vertical spacing between the first and second playing surfaces.

16. A compact table game assembly comprising:

at least one table forming an upwardly facing playing surface; and an elongated barrier assembly extending vertically above said playing surface and horizontally bisecting said at least one upwardly facing playing surface, said vertical barrier operative to define discrete opposed team play areas enabling a plurality of teams to play simultaneously on opposed sides of said barrier and to prevent horizontal travel of ping pong balls between opposing team play areas, said barrier supported by at least one vertically elongated support stanchion dimensioned for removable slip-fit within an associated bore formed within said playing surfaces to enable selective removal and insertion thereof, said barrier comprising a substantially rigid semi-transparent screen having a touch-sensitive reconfigurable electronic display formed on at least one surface thereof; and an electrical controller operative to detect the impact of a game ball against said at least one surface and to generate an optically sensible message on said barrier surface in response thereto.

17. The compact table game assembly of claim 14, wherein said barrier supported by at feast one vertically elongated support stanchion dimensioned for removable slip-fit within an associated bore formed within said playing surfaces to enable selective removal and insertion thereof.

18. A compact game assembly comprising:

at least one ping-pong type game ball;

a vertically extending elongated barrier assembly, said vertical barrier operative to define discrete opposed team play areas enabling a plurality of teams to play simultaneously on opposed sides of said barrier and to prevent horizontal travel of game balls between opposing team play areas, said barrier supported by at least one vertically elongated support stanchion dimensioned for removable slip-fit within an associated bore formed within support structure to enable selective removal and insertion thereof, said barrier comprising a substantially rigid semi-transparent screen having a touch-sensitive reconfigurable electronic display formed on at least one surface thereof; and an electrical controller operative to detect the impact of a game ball against said at least one surface and to generate an optically sensible message on said barrier surface in response thereto.

19. The table game assembly of claim 18, wherein said barrier is supported by at least one vertically elongated support stanchion dimensioned for removable slip-fit within an associated bore formed within said playing surface to enable selective removal and insertion thereof.

20. The table game assembly of claim 19, further comprising a hanger affixed to said barrier assembly operable to effect mounting thereof on a remote vertical surface while maintaining functionality of said game assembly.

* * * * *